US007610002B2

(12) United States Patent
Kabashima

(10) Patent No.: US 7,610,002 B2
(45) Date of Patent: Oct. 27, 2009

(54) DEVELOPING APPARATUS AND IMAGE FORMING APPARATUS

(75) Inventor: Toru Kabashima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 11/682,404

(22) Filed: Mar. 6, 2007

(65) Prior Publication Data

US 2007/0212123 A1 Sep. 13, 2007

(30) Foreign Application Priority Data

Mar. 6, 2006 (JP) ..... 2006-059664

(51) Int. Cl.
*G03G 15/09* (2006.01)

(52) U.S. Cl. ..... 399/269; 399/270; 399/277

(58) Field of Classification Search ..... 399/269, 399/270, 277

See application file for complete search history.

(56) References Cited

U.S. PATENT DOCUMENTS 6,330,414 B1 * 12/2001 Takuma et al. ..... 399/267
6,959,163 B2 10/2005 Nishiyama ..... 399/269
6,978,108 B2 * 12/2005 Sakamaki ..... 399/267
2003/0235437 A1 * 12/2003 Sakamaki ..... 399/267

FOREIGN PATENT DOCUMENTS

JP 2002-365916 12/2002
JP 2004-85629 3/2004
JP 2004085629 A * 3/2004

* cited by examiner

*Primary Examiner*—David M Gray
*Assistant Examiner*—Roy Yi
(74) *Attorney, Agent, or Firm*—Fitzpatrick, Cella, Harper & Scinto

(57) ABSTRACT

An image forming apparatus includes a rotatable image bearing member; a first rotatable developer carrying member for carrying a magnetic one component developer to a first developing position to develop a latent image on the image bearing member; a second rotatable developer carrying member, provided downstream of the first developer carrying member with respect to a rotational direction of the image bearing member, for carrying the magnetic one component developer to a second developing position to develop a latent image on the image bearing member. The second developer carrying member is rotatable in the same rotational direction as the first developer carrying member. The image forming apparatus further includes, a first magnetic member provided in the first developer carrying member and having a plurality of magnetic poles, and a second magnetic member provided in the second developer carrying member, also having a plurality of magnetic poles.

8 Claims, 16 Drawing Sheets

DEVELOPING APPARATUS AND IMAGE FORMING APPARATUS

FIELD OF THE INVENTION AND RELATED ART

The present invention relates to a developing apparatus which develops an electrostatic latent image formed on an image bearing member, such as an electrophotographic photosensitive member, with the use of, for example, an electrophotographic method, into a developer image (image formed of developer). It also relates to an image forming apparatus which employs such a developing apparatus.

FIG. 14 shows the general structure of an example of an image forming apparatus which employs an electrophotographic method in accordance with the prior art.

This example of an image forming apparatus employs an electrophotographic photosensitive member 100, as an image bearing member. The photosensitive member 100 is in the form of a drum (which, hence, will be referred to as "photosensitive drum" hereafter). The photosensitive drum 100 has a photoconductive surface layer formed of amorphous silicon, organic photoconductor, or the like. It is rotated in the direction indicated by an arrow mark in the drawing (clockwise direction) by an unshown driving system.

First, the charging method for charging the peripheral surface of the photosensitive drum 100 will be described. A primary charging device 101 can charge the peripheral surface of the photosensitive drum 100 to a desired potential level, for example, +600 V. After the charging of the peripheral surface of the photosensitive drum 100, the surface is exposed to a beam of laser light emitted, while being modulated with picture signals, by an exposing apparatus (unshown). As a result, the potential of the numerous exposed points of the charged peripheral surface of the photosensitive drum 100 reduces to +200 V, for example. As a result, a latent image, which reflects the picture signals, is effected on the peripheral surface of the photosensitive drum 100.

The electrostatic image on the photosensitive drum 100 is developed in reverse by a developing apparatus 102, into a visible image. More specifically, when the polarity of the developer in the developing apparatus 102 is the same as that of the photosensitive drum 100 (for example, positive), the electrostatic image is developed into a visible image by applying positive high voltage to the developing apparatus 100.

Incidentally, there is available the so-called normal developing method. When this developing method is used, the charged peripheral surface of the photosensitive drum 100 is exposed to the beam of laser light L emitted, while being modulated with picture signals which correspond to the solid white portions (background portions) of an intended image, by an exposing apparatus to reduce the surface potential of the exposed points of the peripheral surface of the photosensitive drum 100 to +200 V, for example, effecting thereby an electrostatic image. Then, the electrostatic image is developed with the use of developer which is negative in native polarity, by applying negative high voltage to the developing apparatus.

As high voltage is applied to a developer bearing member 102*a*, the peripheral surface of which is bearing a coat of developer, the developer particles in the coat of developer on the peripheral surface of the developer bearing member 102 jump onto the peripheral surface of the photosensitive drum 100, developing thereby the electrostatic image on the peripheral surface of the photosensitive drum 100 into a visible image. The reversal developing method can develop an electrostatic image into a visible image with the use of developer which is the same in polarity as the polarity to which the peripheral surface of the photosensitive drum 100 is charged. In comparison, when the normal developing method is used, an electrostatic latent image is developed into a visible image with the use of developer which is opposite in polarity to the potential given to the photosensitive drum 100.

After the development of the electrostatic image into the developer image, or a visible image, the developer image is given electric charge by a pre-transfer charging device 103 (post-development charging). This process is for weakening the electrostatic force which acts in the direction to keep the developer and photosensitive drum 100 adhered to each other when transferring the developer image (visible image) with a transfer charging device 104. In other words, it is for making it easier to separate transfer medium, such as a recording medium P, from the photosensitive drum 100 during the next step, that is, the transferring step.

Meanwhile, one of the recording mediums P in an unshown paper feeder cassette is fed into the main assembly of the image forming apparatus by a paper feeder roller (unshown), is corrected in attitude by a registration roller (unshown), and then, is conveyed to the transferring portion by the registration roller, with such timing that it arrives at the same time as the leading edge of the visible image on the peripheral surface of the photosensitive drum 100 in the developer image forming portion arrives at the transferring portion (charging device) 104. Then, the recording medium P is conveyed through the transferring portion 104. The developer on the photosensitive drum 100 can be electrostatically peeled from the photosensitive drum 100, and transferred onto the recording medium P, by applying voltage which is opposite in polarity to the developer, to the delivered recording medium P.

The recording medium P can be separated from the photosensitive drum 100 by a charging device 105 for separating the recording medium P from the photosensitive drum 100.

After the transfer of the developer image, or the visible image, onto the recording medium P, the recording medium P is conveyed to the fixing apparatus 107, and is conveyed through the nip formed by the fixation roller 107*a* and pressure roller 107*b* of the fixing apparatus 107. While the recording medium P is conveyed through the nip, the developer (image) on the recording medium P is subjected to pressure and heat. As a result, the developer (image) becomes fixed to the recording medium P. Then, the recording medium P is discharged from the image forming apparatus.

The transfer residual toner, that is, the toner remaining on the immediately downstream area of the peripheral surface of the photosensitive drum 100, with reference to the recording medium separating charging device 105, after the transfer of the developer image, is removed by the cleaning apparatus 106, and is collected into an unshown developer recovery container.

The above described developing apparatus 102, which is based on the prior art, is such a developing apparatus that uses single-component magnetic toner as the developer, and the jumping developing method. Unlike an ordinary developing apparatus, which uses two-component developer, this type of developing apparatus does not require carrier, and therefore, it does not require the maintenance step for replacing or replenishing the developing apparatus with carrier. In addition, it does not require the means for detecting and adjusting the ratio between toner and carrier. In other words, a developing apparatus which uses single-component magnetic toner requires less maintenance, and is longer in service life, than a developing apparatus which uses two-component developer.

Next, referring to FIG. 15, the developing apparatus 102, which uses the above described single-component magnetic toner, and the jumping developing method, will be described.

The photosensitive drum 100 and the developer bearing member 102*a* of the developing apparatus 102 are disposed so that a preset amount of gap G is provided between the photosensitive drum 100 and developer bearing member 102*a*; they are disposed with no contact between them. The developer bearing member 102*a* rotates in the same direction (indicated by arrow mark in drawing) as the photosensitive drum 100. The peripheral surface of the developer bearing member 102*a* is coated with toner, and the amount by which the coated toner on the developer bearing member 102*a* is allowed to remain on the peripheral surface of the developer bearing member 102*a* per unit area is regulated by the developer amount regulating member 102*b*. The developing apparatus 102 is also provided with a magnetic roll 102*c*, as a magnetic field generating means, which is stationarily disposed in the hollow of the developer bearing member 102*a*. The magnetic roller 102*c* is provided with multiple magnetic poles.

The operation of this developing apparatus 102 is as follows: As the developer bearing member 102*a* is rotated, the single-component magnetic toner is borne on the peripheral surface of the developer bearing member 102*a*. Then, as the developer bearing member 102*a* further rotates, the body of toner on the peripheral surface of the developer bearing member 102*a* is regulated by the developer amount regulating member 102*b* while being magnetically confined by the magnetic roller 102*c*. As the body of toner is regulated by the developer amount regulating member, the toner particles in the body of developer on the peripheral surface of the developer bearing member 102*a* are rubbed against each other and/or the surface of the developer bearing member 102*a*, being thereby given triboelectrical charge. Thus, as development bias voltage is applied to the peripheral surface of the developer bearing member 102*a*, with the use of an unshown voltage applying means, the toner particles are made to jump onto the photosensitive drum 100, by the difference between the potential level of the development bias applied to the developer bearing member 102*a* and the potential level of the latent image on the peripheral surface of the photosensitive drum 100, developing thereby the electrostatic image into a visible image.

In recent years, an image forming apparatus, such as a copying machine or a printer, has been increased in operational speed in response to user requests. In order to increase an image forming apparatus in operation speed, the developer bearing member of the developing apparatus had to be increased in peripheral velocity. Thus, the length of time for developing the electrostatic image on the photosensitive drum into a visible image, with the developer on the developer bearing member, became shorter, causing the problem that a latent image fails to be properly developed.

In addition to the request for higher operational speed, the request for longer durability and greater reliability has also been increasing.

It has been known that the level of quality at which an image is formed by an image forming apparatus based on the prior electrophotographic art is easily affected by the condition under which it is used, and/or requirements which a user places on the image forming apparatus. For example, it has been known to be easily affected by the ambience in which the apparatus is used, the type of recording medium, the number of copies made per day by the apparatus, the image ratio of an original, etc.

In recent years, businesses have greatly improved in efficiency. As a result, the length of time an image forming apparatus is used has become a serious issue. Thus, desire has been increasing for a high speed image forming apparatus which is so high in productivity and so long in durability that it can be continuously operated as long as ten hours.

The image forming apparatuses disclosed in the following patent applications are the results of some of the attempts made to accommodate the above described desires. For example, referring to FIG. 16, the developing apparatus 102 disclosed in Japanese Laid-open Patent Application 2004-85629 is provided with multiple (two) developer bearing members 102*a*1 and 102*a*2, which are disposed virtually in contact with the photosensitive drum 100 and rotate in the same direction as the photosensitive drum 100.

In the case of the above described structural arrangement, the higher operational speed and higher level of reliability are achieved by: providing the developing apparatus with two developer bearing members 102*a*1 and 102*a*2, and two magnetic rolls 102*c*1 and 102*c*2, as magnetic field generating means, disposed in the hollows of the developer bearing members 102*a*1 and 102*a*2, respectively; and controlling the polarity, half-width, and angle (relative to line of shortest distance between two developer bearing members) for each of the magnetic poles placed in the area in which the distance between the two developer bearing members 102*a*1 and 102*a*2 is smallest.

In the case of Japanese Laid-open Patent Application 2002-365916, the high speed is dealt with by the employment of the following structural arrangement. That is, referring to FIG. 17, the developing apparatus 102 is provided with multiple (two) developer bearing members 102*a*1 and 102*a*2, which contain magnetic rolls 102*c*1 and 102*c*2 in their hollows, respectively. The two magnetic rolls 102*c*1 and 102*c*2 are disposed so that the magnetic pole S1 (which corresponds to magnetic pole A in FIG. 17(*b*)) of the magnetic roller 102*c*1, and the magnetic pole N2 (which corresponds to magnetic pole C in FIG. 17(*b*)) of the magnetic roll 102*c*2, oppose each other across the gap between the two developer bearing members 102*a*1 and 102*a*2, at the point at which the gap is narrowest. This structural arrangement is adopted to deal with the higher speed of the apparatus, by making the strengths |A|, |B| and, |C| of the magnetic poles A, B, and C, respectively, satisfy the following inequality: $|A|>|B|>|C|$.

FIG. 18 shows an example of a conventional developing apparatus which uses two-component developer, instead of magnetic single-component developer. This developing apparatus is one of the developing apparatuses which were proposed as developing apparatuses (systems) which use two-component developer, and yet, are faster, higher in quality, more durable, and higher in image quality.

This example of a conventional developing apparatus 300 is provided with multiple (two) developer bearing members 302*a*1 and 302*a*2. The developer layer on the developer bearing member 302*a*1 is regulated by a regulating member 302*b*, and is conveyed in the direction indicated by an arrow mark 300A. The toner particles in the regulated developer layer are made to jump onto the photosensitive drum 100 by the magnetic pole S1, or the development pole, of the magnetic roll 302*c*1, and then, the toner particles remaining in the regulated developer layer are conveyed with the carrier in the regulated developer layer, toward the magnetic pole S1 of the magnetic roll 302*c*2 in the developer bearing member 302*a*2, following the directions indicated by arrow marks 300D and 300E. While they are conveyed by the magnetic roll 302*c*2 as indicated by the arrow marks 300D and 300E, they are made to jump onto the peripheral surface of the photosensitive drum 100 by the development pole N1 of the magnetic roll 302c2 in the developer bearing member 302a2 to develop the electrostatic image on the peripheral surface of the photosensitive drum 100 for the second time.

Generally, in the case of a development system, such as the above described one, employed by a developing apparatus which employs multiple developer bearing members and uses two-component developer, the developer conveyance path is such that the developer on the developer bearing member 302a1, or the upstream developer bearing member, is conveyed onto the developer bearing member 302a2, or the downstream developer bearing member, as indicated by the arrow marks. Therefore, a developing apparatus which employs multiple developer bearing members is greater in the overall size of the development nip, being therefore capable of more precisely adhering toner to an electrostatic image, than a developing apparatus which employs a single developer bearing member. In addition, it can prevent the formation of an image which suffers from unwanted white spots which are attributable to the nonuniformity of the potential of the peripheral surface of the photosensitive drum 100, and which are located in the border line areas between the solid areas and halftone areas of the image.

However, the conventional developing apparatuses described above suffer from the various shortcomings which will be described next:

(a) In the case of the developing apparatus which employs the structural arrangement shown in FIG. 18 and employs two-component developer, its developer bearing members are used primarily for developer conveyance, and the toner particles are charged by the friction between the carrier and toner particles in the developing means container. Therefore, if singe-component magnetic toner is used by a developing apparatus which employs the structural arrangement employed by any of the above described developing apparatuses which were designed to be used with two-component developer, it is impossible to obtain a satisfactory image;

(b) In the case of the developing apparatus whose development pole is regulated in magnitude, developer (toner) flows from the developer bearing member 302a2 to the developer bearing member 302a1, being therefore likely to stagnate in a certain area. Therefore, this type of developing apparatus is problematic in terms of long term stability in image quality. In particular, if it is used in an environment in which toner tends to agglomerate, and/or the developing bearing members are rotated at a higher velocity, toner is subjected to a large amount of load, being therefore likely to become packed;

(c) In the case of the developing apparatus in which the development poles of the top and bottom developer bearing members are regulated in position and half-width, the half-width is greater on the photosensitive drum side than on the developing means container side. Therefore, while developer is circulated in the developing means container, developer flows from the developer bearing member 302a2 to the developer bearing member 302a1 following the directions 300F and 300G, being therefore likely to stagnate and agglomerate in a certain point in its path.

The occurrence of the above described toner stagnation areas prevents the peripheral surface of each developer bearing member from being coated with a uniform layer of toner, and also, reduces the efficiency with which toner particles are given triboelectric charge in the area in which the distance between the peripheral surfaces of the developer bearing members 302a1 and 302a2 is smallest. This phenomenon is one of the primary causes of the formation of an image which is inferior in overall quality.

Therefore, when magnetic single-component toner (single-component developer) was used with a conventional developing apparatus, it was difficult to reliably form a thin and uniform layer of developer (toner) on the developer bearing members 302a1 and 302a2, in particular, the developer bearing 302a2, or the downstream developer bearing member in terms of the developer conveyance direction, and therefore, satisfactory development was impossible.

SUMMARY OF THE INVENTION

The primary object of the present invention is to improve a developing apparatus in terms of the developer conveyance between the adjacent two developer bearing members of the developing apparatus, by preventing magnetic single-component developer from becoming stagnant between the two developer bearing members.

According to an aspect of the present invention, there is provided a An image forming apparatus comprising a rotatable image bearing member; a first rotatable developer carrying member for carrying a one component magnetic developer; a second rotatable developer carrying member, provided downstream of said first developer carrying member with respect to a rotational direction of said image bearing member, for carrying the one component magnetic developer, said second developer carrying member being disposed in proximity with said first developer carrying member and being rotatable in the same direction as said first developer carrying member; a first magnetic member having a first magnetic pole disposed opposed to said image bearing member, a second magnetic pole disposed at a position where said first developer carrying member and said second developer carrying member are in proximity with each other, a third magnetic pole disposed between said first magnetic pole and said second magnetic pole, wherein said first magnetic pole and said second magnetic pole have the same magnetic polarity, said third magnetic pole has a magnetic polarity which is opposite the polarity of said first magnetic pole and is disposed in said first developer carrying member; and a second magnetic member provided in said second developer carrying member, said second magnetic member having a fourth magnetic pole having the same magnetic polarity as said first magnetic pole and disposed opposed to said image bearing member, and a fifth magnetic pole having a magnetic polarity opposite that of said second magnetic pole and disposed at a position substantially opposing to said second magnetic pole.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the developing apparatuses in accordance with the present invention will be described in more detail with reference to the appended drawings. Although two preferred embodiments of the present invention are described in this specification, these embodiments are not intended to limit the present invention in scope.

Embodiment 1

Figure 1:
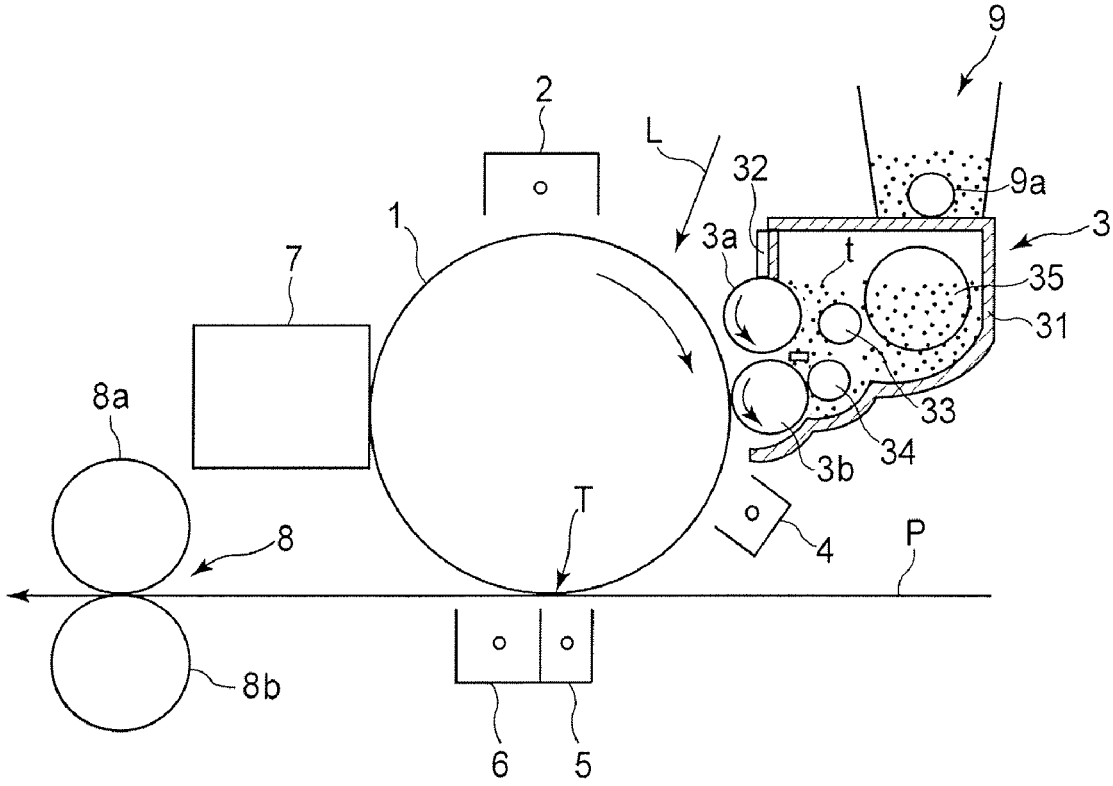
FIG. 1 is a schematic drawing of an example of an image forming apparatus equipped with a developing apparatus in accordance with the present invention, depicting the general structure thereof.
Figure 2:
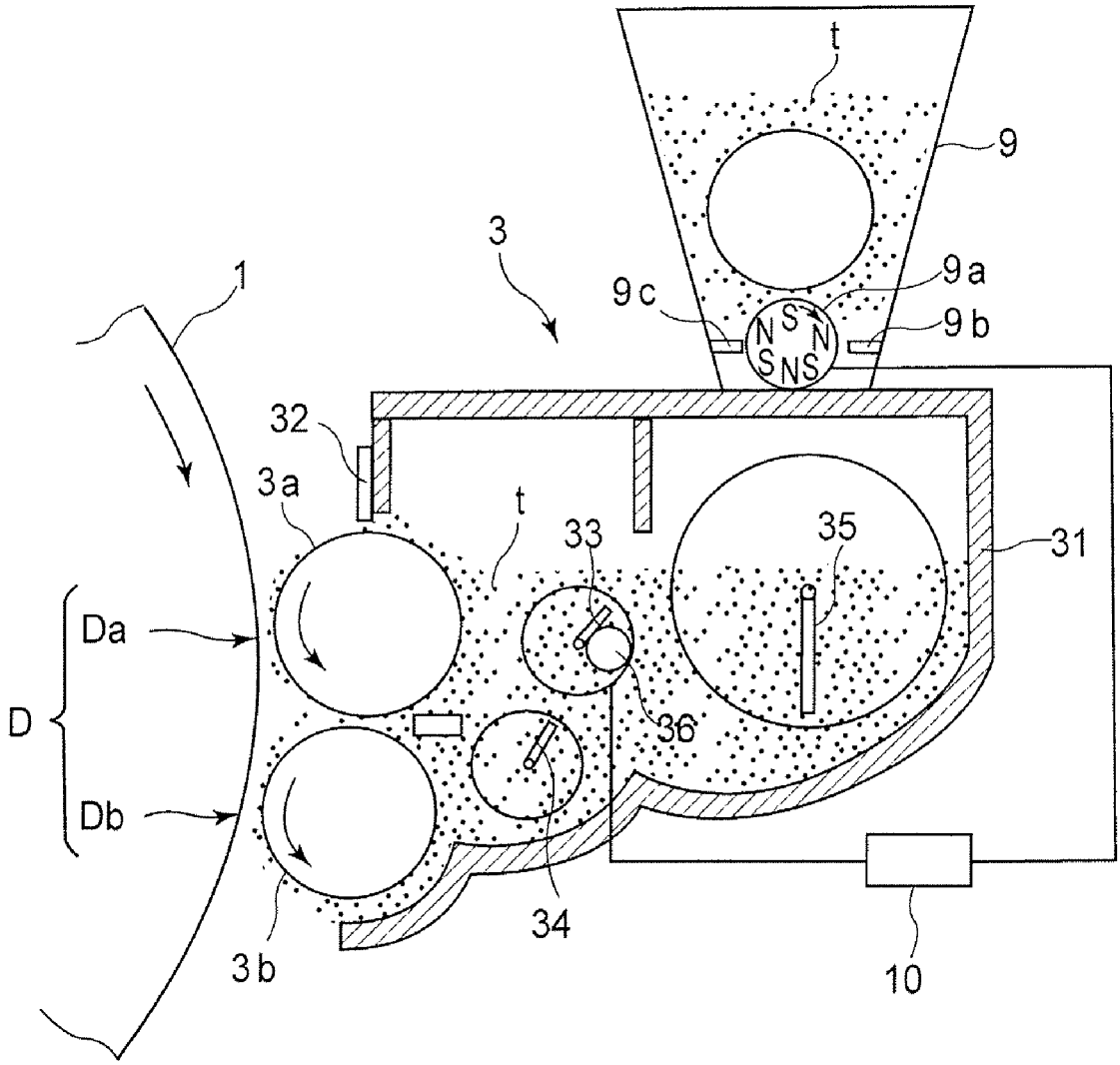
FIG. 2 is a schematic drawing of an example of a developing apparatus in accordance with the present invention, depicting the general structure thereof.

FIG. 1 is a schematic drawing of an image forming apparatus equipped with the developing apparatus in this embodiment of the present invention, and shows the general structure thereof. FIG. 2 is a schematic drawing of the developing apparatus in this embodiment, and shows the general structure thereof.

The image forming apparatus in this embodiment is provided with an electrophotographic photosensitive member 1, as an image bearing member, which is in the form of a drum, more specifically, a photosensitive member (which hereafter will be referred to as "photosensitive drum") whose photosensitive layer is formed of amorphous silicon which is negative in native polarity.

In the adjacencies of the peripheral surface of the photosensitive drum 1, a primary charging device 2, a developing apparatus 3, a pre-transfer charging device 4 (post-charging device), a transfer charging device 5, a separation charging device 6, and a cleaning apparatus 7 are disposed. Disposed on the downstream side of the transfer portion T between the photosensitive drum 1 and transfer charging device 5, in terms of the transfer medium conveyance direction, is a fixing apparatus 8.

The photosensitive drum 1 in this embodiment is 84 mm in diameter. When forming an image, the photosensitive drum 1 is rotating in the clockwise direction (direction indicated by arrow mark) at a preset peripheral velocity (which is 450 mm/sec in this embodiment). The photosensitive drum 1 is charged by the primary charging device 2 to +500 V, for example. Then, an electrostatic image, which reflects the picture information inputted into the image forming apparatus, is formed on the photosensitive drum 1 by the beam of exposure light L emitted by an exposing apparatus (unshown).

This electrostatic image is developed by the developing apparatus 3 which uses the jumping developing method; the charged developer t which is opposite in polarity to the charge given to the photosensitive drum 1, is adhered to the peripheral surface of the photosensitive drum 1 by the developer bearing members 3*a* and 3*b* to turn the electrostatic image into a visible image, or an image formed of toner. The developer t in this embodiment is magnetic single-component toner. To the developer bearing members 3*a* and 3*b* of the developing apparatus 3, development bias (combination of DC and AC voltages), which is the same in polarity as that of the charge given to the photosensitive drum 1, is applied. The details of the developing apparatus 3 in this embodiment will be given later.

The peripheral surface of the photosensitive drum 1, which is bearing the toner image, is charged by the pre-transfer charging device 4 (post-charging device) before the toner image is transferred. Meanwhile, one of the recording mediums P in a paper feeder cassette (unshown) is fed into the main assembly of the image forming apparatus, and is conveyed to the transfer portion T, which is between the photosensitive drum 1 and transfer charging device 5, so that it will reach the transfer portion T at the same time as the area of the peripheral surface of the photosensitive drum 1, across which the toner image is present, reaches the transfer portion T. In the transfer portion T, the toner image is transferred onto the recording medium P by the transfer charging device 5 to which transfer voltage, which is opposite in polarity to the toner particles in the toner image, is being applied. After the transfer of the toner image onto the recording medium P, the recording medium P is separated from the photosensitive drum 1 by the separation charging device 6, and is conveyed to the fixing apparatus 8. In the fixing apparatus 8, the toner image on the recording medium P and the recording medium P are subjected to heat and pressure in the fixation nip, or the contact nip between the fixation roller 8*b* and pressure roller 8*b* of the fixing apparatus 8. As a result, the toner image becomes thermally fixed to the recording medium P. Thereafter, the recording medium P is discharged from the image forming apparatus.

As for the transfer residual toner, or the toner remaining on the peripheral surface of the photosensitive drum 1 after the transfer of the toner image, is removed and recovered by the cleaning apparatus 7.

Next, the developing apparatus 3 in this embodiment will be described in detail.

Referring to FIG. 2, the developing apparatus 3 in this embodiment is provided with the developer bearing members 3*a* and 3*b*, which are in the latent image developing portions D (Da and Db) in which the developer bearing members 3*a* and 3*b* oppose the peripheral surface of the photosensitive drum 1. More specifically, the developer bearing members 3*a* and 3*b* are in the opening portion of the developing means container 31 so that their peripheral surfaces are located close to the peripheral surface of the photosensitive drum 1. In terms of the rotational direction of the photosensitive drum 1, the developer bearing member 3*a* is positioned upstream of the developer bearing member 3*b*. The developer bearing members 3*a* and 3*b* are freely rotatable in the direction (counterclockwise direction) indicated by arrow marks. In this embodiment, the developer bearing members 3*a* and 3*b* are rotated in the same direction at the same peripheral velocities so that the direction in which their peripheral surfaces move in the two areas Da and Db of the developing portion D, in which the developer bearing members 3*a* and 3*b* oppose the peripheral surface of the photosensitive drum 1, respectively, are the same as the direction in which the peripheral surface of the photosensitive drum 1 moves in the developing portion D.

As shown in the drawing, in terms of the rotational direction of the photosensitive drum 1, the area Da of the developing portion D, that is, the area between the developer bearing member 3*a*, or the first developer bearing member, and photosensitive drum 1, is located upstream of the area Db of the developing portion D, that is, the area between the developer bearing member 3*b*, or the second developer bearing member, and photosensitive drum 1.

The layer of toner t on the developer bearing member 3*a*, or the upstream developer bearing member in terms of the rotational direction of the photosensitive drum 1, is regulated in thickness by a thickness regulation blade 32. However, the layer of toner t on the developer bearing member 3*b*, or the upstream developer bearing member in terms of the rotational direction of the photosensitive drum 1, is regulated in thickness by the developer bearing member 3*a*, which is in the immediate proximity of the developing bearing member 3*b*.

In the developing means container 31, toner stirring members 33, 34, and 35 are disposed, which convey the toner t in the developing means container 31 toward the developer bearing members 3*a* and 3*b* while stirring the toner t. Also disposed in the developing means container is a toner amount detection sensor 36 which detects the amount of the toner t in the developing means container 31.

The toner t used in this embodiment is negative toner, the weight average particle diameter of which is in a range of 5.0-7.5 μm. Its resinous component is styrene-acrylic resin or a polyester resin, and the weight ratio of its resinous component is in a range of 70-90 parts. It also contains silicon dioxide, as an external additive, the ratio (weight ratio) of which is in a range of 0.5-1.5%.

The developing apparatus 3 is also provided with a replenishment toner container 9, which is located in the top portion of the developing means container 31. The replenishment toner container 9 contains the replenishment toner t which is to be supplied to the developing means container 31. As it is detected by the toner amount detection sensor 36 during a developmental operation that the amount of the toner t in the developing means container 31 has reduced to a level slightly below a preset level, the replenishment toner t in the replenishment toner container 9 is supplied into the developing means container 31; the replenishment toner t is discharged into the developing means container 31 by rotating the magnetic roller 9*a* located in the toner outlet of the replenishment toner container 9, in response to a control signal from a controlling apparatus 10.

Next, the replenishment of the developing means container 31 with the replenishment toner t will be described in more detail.

The replenishment toner t in the replenishment toner container 9 is attracted to the peripheral surface of the magnetic roller 9*a* by the magnetic force of the magnetic roller 9*a* while rotating the magnetic roller 9*a*. Thus, the layer of toner t adhered to the peripheral surface of the magnetic roller 9*a* is regulated in the amount per unit area, by a toner regulation plate 9*b* positioned so that a preset amount of gap is provided between the toner regulation plate 9*b* and peripheral surface of the magnetic roller 9*a*. As a result, a layer of the toner t, which is uniform in thickness (uniform in amount per unit area) is formed on the peripheral surface of the magnetic roller 9*a*. This layer of toner t is scraped down into the developing means container 31 by a toner scraping plate 9*c*, which is in contact with the peripheral surface of the magnetic roller 9*a*; in other words, the developing means container 31 is replenished with the replenishment toner t. The replenished toner t mixes with the toner t in the developing means container 31 by being stirred by the toner stirring member 35.

Each of the developer bearing members 3*a* and 3*b* is a cylindrical member formed of SUS305 (nonmagnetic substance), which is 20 mm in diameter. The surface roughness Rz of the each developer bearing member is 3 μm, which was achieved by blasting with #600 FGB. As the means for measuring the surface roughness of the developer bearing members 3*a* and 3*b*, a surface roughness gauge of the contact type (Surf-corder SE-3300: product of Kosaka Lab. Co., Ltd.) was used. As for the measurement conditions, the cutoff value was 0.8 mm, and the measurement length was 2.5 mm. Further, the peripheral velocity was 0.1 mm/sec, and the magnification was 5,000 times.

Figure 3:
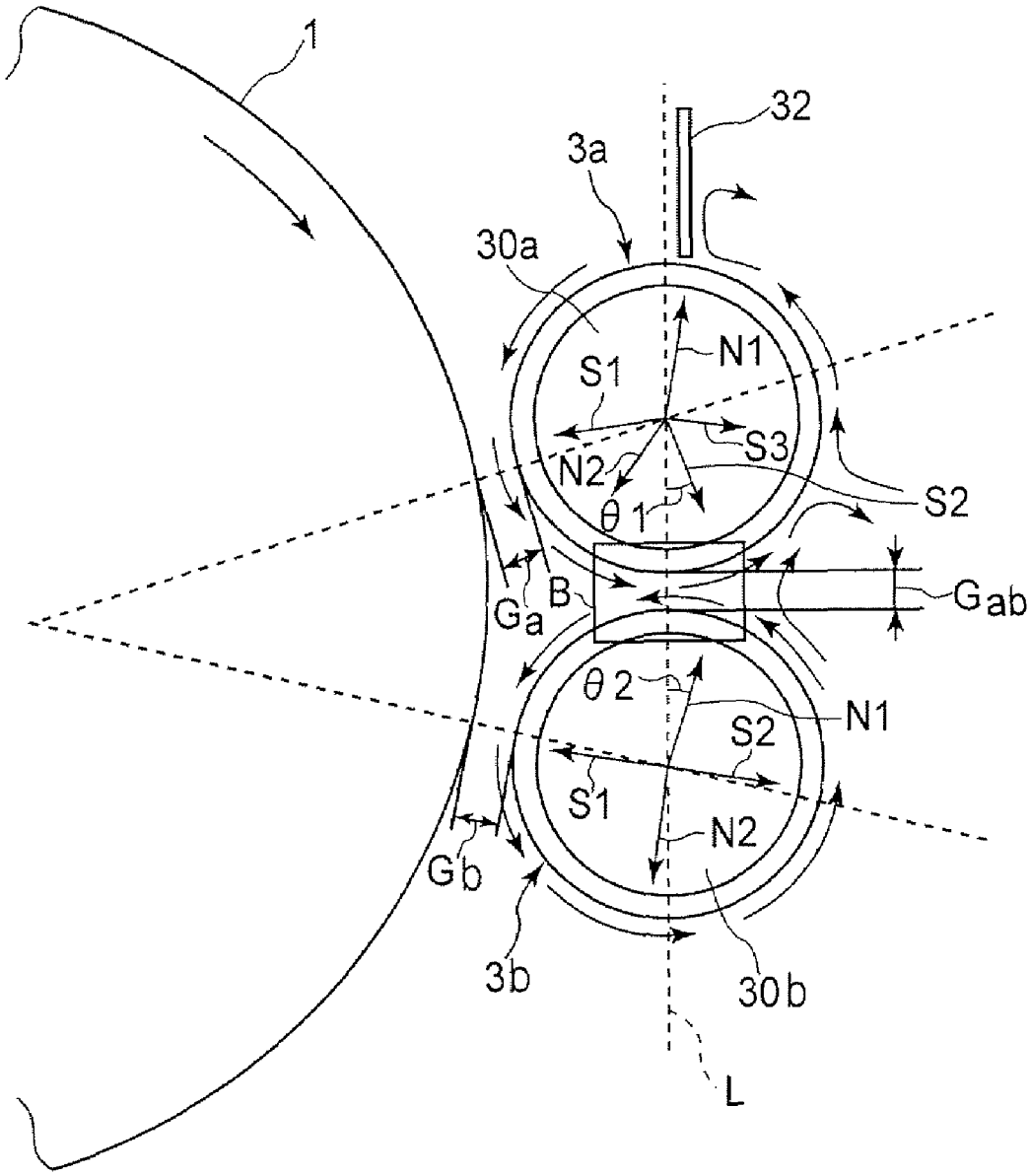
FIG. 3 is a schematic drawing of the developing apparatus, depicting the positioning of the magnetic poles.
Figure 4:
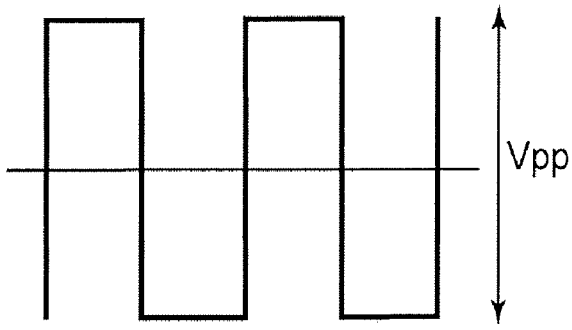
FIG. 4 is a drawing showing the waveform of the development bias used by the developing apparatus in this embodiment.

Referring to FIG. 3, in the hollows of the developer bearing members 3*a* and 3*b*, stationary magnetic rolls 30*a* and 30*b* are located, respectively. Each of the magnetic rollers 30*a* and 30*b*, as first and second magnetic members, respectively, is provided with multiple magnetic poles (N1, N2, S1, and S2), which are arranged in the patterns shown in FIG. 3. The pattern of the magnet arrangement (magnetic pole arrangement) will be described later in more detail.

The developer bearing members 3*a* and 3*b* rotate at such a peripheral velocity that is equal to 100-150% of the peripheral velocity (process speed) of the photosensitive drum 1. The gap Ga, or the gap between the developer bearing member 3*a* and photosensitive drum 1 in the developing portion, and the gap Gb, or the gap between the developer bearing member 3*b* and photosensitive drum 1 in the developing portion, are 150-400 μm. The developer bearing member 3*a* is coated with the toner in the developing means container 31 by the magnetic force of the stationary magnetic roll 30*a*, and then, the body of toner on the developer bearing member 3*a* is regulated in thickness by the toner layer regulation blade 32. The developer bearing member 3*b* is coated with the toner in the developing container 32 by the magnetic force of the stationary magnetic roll 30*b*, and then, the body of toner on the developer bearing member 3*b* is regulated in thickness by the developer bearing member 3*a*. A gap Gab, or the distance between the developer bearing members 3*a* and 3*b* on the straight line connecting the rotational centers of the developer bearing members 3*a* and 3*b*, is 200-400 μm.

To the developer bearing members 3*a* and 3*b*, development bias, which is a combination of −300 V of DC bias, and AC bias, is applied from an unshown development bias power source, in order to cause the toner (magnetic single-component toner) on the developer bearing members 3*a* and 3*b* to jump (that is, with no contact between developer bearing members 3 and photosensitive drum 1) onto the photosensitive drum 1 and develops the electrostatic image on the photosensitive drum 1.

Incidentally, the abovementioned AC bias is an AC voltage which is 900-1,700 V in peak-to-peak voltage (Vpp), 1.2-3.6 kHz in frequency, and rectangular in waveform. Although the AC voltage used in this embodiment is rectangular in waveform, it needs to be optimized in waveform according to various factors, such as toner type, photosensitive drum type, latent image forming method, etc. In this embodiment, the developmental contrast, or the contrast for causing the toner to jump onto the photosensitive drum 1, is set to 200 V, and the fog prevention contrast is set to 150 V.

As described above, in this embodiment, in addition to DC bias, AC bias is applied to the developer bearing members 3*a* and 3*b*. With the application of the AC bias, the toner particles which jumped onto the photosensitive drum 1 from the developer bearing member 3*a*, but, did not contribute to the development, can be recovered, and returned into the developing means container 31, by the developer bearing member 3*b*, reducing thereby toner consumption.

For example, when copies of an original with an image ratio of 6% were outputted with the use of an image forming apparatus equipped with a conventional developing apparatus which used magnetic single-component toner, the toner consumption was in a range of 50-60 mg/copy. However, when an image forming apparatus equipped with the developing apparatus 3 in this embodiment was used for the same job, the toner consumption was roughly 40 mg/copy.

Figure 5:
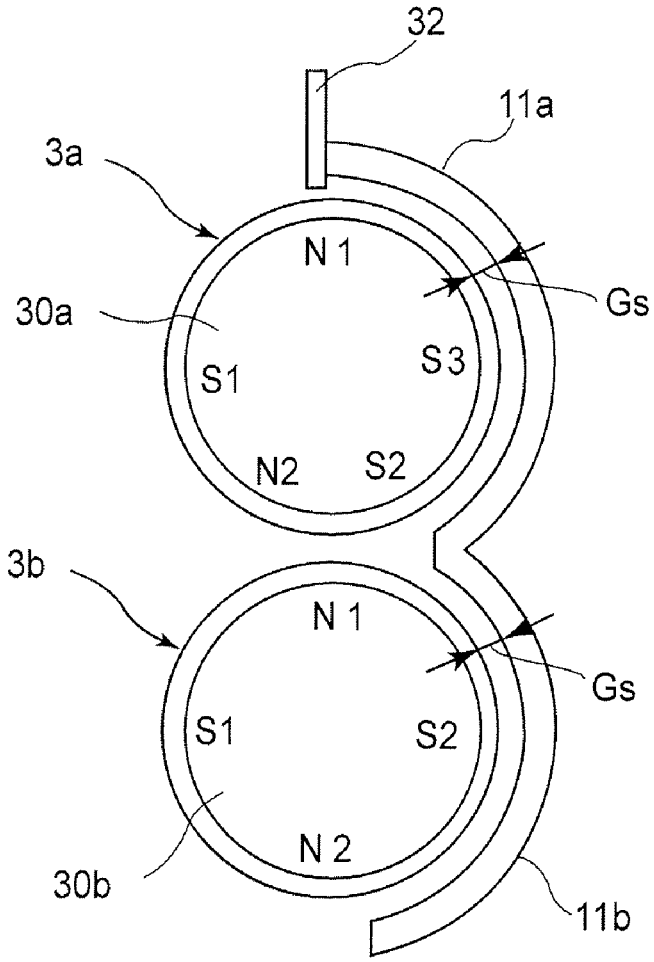
FIG. 5 is a schematic drawing of the lengthwise ends of the developer bearing members of the developing apparatus, and the end seal disposed next to the end portions of the developer bearing members.

Referring to FIG. 5, the developing apparatus 3 is provided with a pair of magnetic sealing members 11, each of which is made up of sections 11*a* and 11*b*. The sections 11*a* and 11*b* are shaped so that the sealing surface of the sections 11*a* and the sealing surface of the section 11*b* match in curvature the peripheral surface of the developer bearing member 3*a* and the peripheral surface of the developer bearing member 3*b*, respectively. The sealing members 11 are disposed so that the sections 11*a* and 11*b* of each sealing member 11 fit around the lengthwise end portions of the developer bearing members 3*a* and 3*b*, respectively. Each magnetic sealing member 11 is formed of MOLDALLOY (KN-plated: 10-6 in magnetic permeability), the primary component of which is iron, or plastic magnet (Nd—Fe—B: plastic magnet, remnant magnetism Br of which is in range of 400-800 mT). The gaps Gs, or the distance between the peripheral surface of each developer bearing member 3 and the sealing surface of the corresponding magnetic seal 11, was set to 400 μm ñ 200 μm.

It is desired that the magnetic seals 11 are positioned so that their sections 11*a* and 11*b* align with the lengthwise end portions of the corresponding developer bearing members 3*a* and 3*b* in the direction perpendicular to the axial line of each developer bearing member 3, for the following reason. That is, if the lengthwise end of the stationary magnetic roll 30 (30*a*, 30*b*) is on the outward side of the magnetic seal 11 (11*a*, 11*b*) in terms of the lengthwise direction of the magnetic roll 30, the magnetic roll 30 generates a magnetic field on the outward side of the magnetic sealing member 11. Therefore, the toner is carried outward by this magnetic field; toner is made to leak by this magnetic field.

On the other hand, if the lengthwise end of the stationary magnetic roll 30 is located excessively inward of the outward edge of the magnetic seal 11, the following problem occurs.

That is, naturally, the magnetic force of the magnetic sealing member 11 and the magnetic force of the magnetic roll 30 forms a magnetic brush between them. Therefore, if the positional relationship between the magnetic roll 3 and the magnetic sealing member 11 is correct, there will be no magnetic force on the outward side of the magnetic sealing member 11. However, if the lengthwise end of the magnetic roll 30 is located excessively inward of the outward edge of the magnetic sealing member 11, a magnetic brush, the width of which equals that of the magnetic sealing member 11, is formed on the developer bearing members 3 (3*a* and 3*b*). Therefore, not only will the toner borne on the outward area of the developer bearing member, relative to the magnetic sealing member 11, leak at the lengthwise end of the developer bearing member 3, but also, it will accumulate thicker, sometimes falling off in a lump from the developer bearing member 3.

Figure 6:
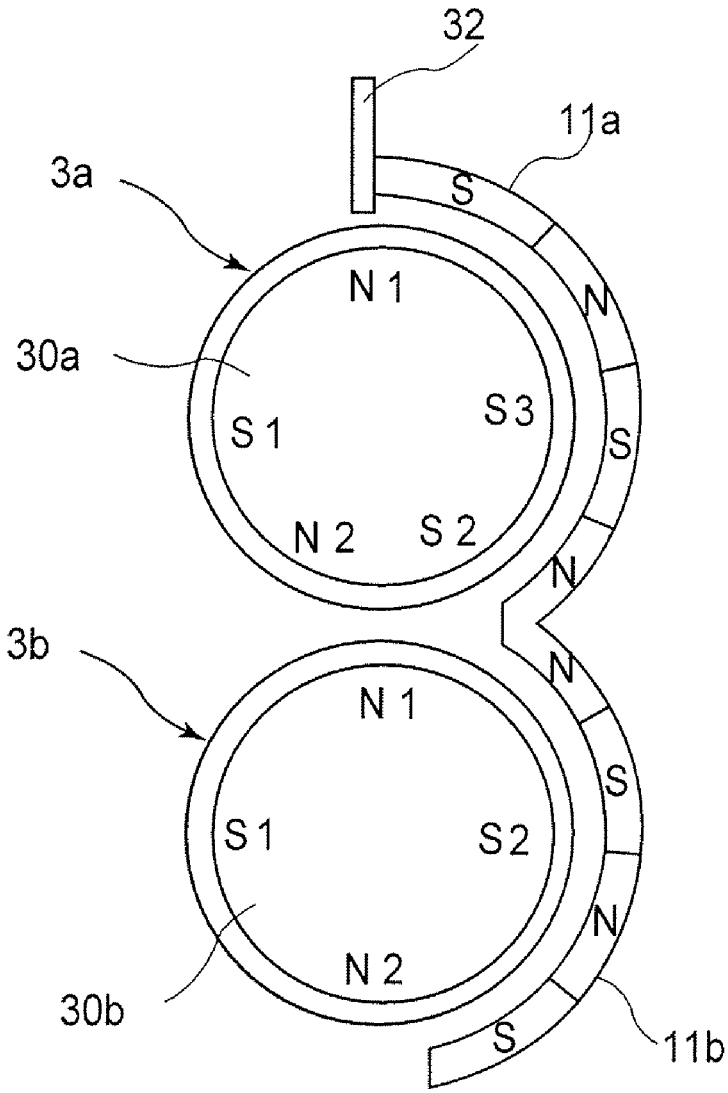
FIG. 6 is a schematic drawing of the magnetic end seal located next to the lengthwise end portions of the developer bearing members of the developing apparatus, depicting the general structure thereof.

The problem that when the developer bearing members 3*a* and 3*b* are rotated at a high speed, the toner leaks from the portion of the developing apparatus, which corresponds in position to the end of the developer bearing member 3, can be solved by the employment of a magnetic seal 11 (11*a*, 11*b*), shown in FIG. 6, which is made up of a plastic magnet. The employment of these magnetic sealing members 11 prevents the toner from scattering, by forming a stronger magnetic field between the magnetic roll 30*a* and 30*b* and magnetic sealing members 11*a* and 11*b*, respectively. The magnetic seal 11*a* is provided with four magnetic poles S, N, S, and N arranged in the listed order so that the magnetic pole S, that is, the opposite in polarity to the pole N, of the magnetic seal 11*a* opposes the magnetic pole N1 of the magnetic roll 30*a*, in the adjacencies of the toner layer regulating member 32, to prevent the toner leak. The magnetic seal 11*b* is provided with magnetic poles N, S, N, and S, which are arranged in the listed order so that the magnetic pole S, that is, the opposite in polarity to the pole N, of the magnetic seal 11*b* opposes the magnetic pole N2 of the magnetic roll 30*b*, to prevent the toner from leaking at the lengthwise end.

Next, the developer bearing members 3*a* and 3*b* of the developing apparatus 3 in this embodiment will be described in even more detail.

Figure 7:
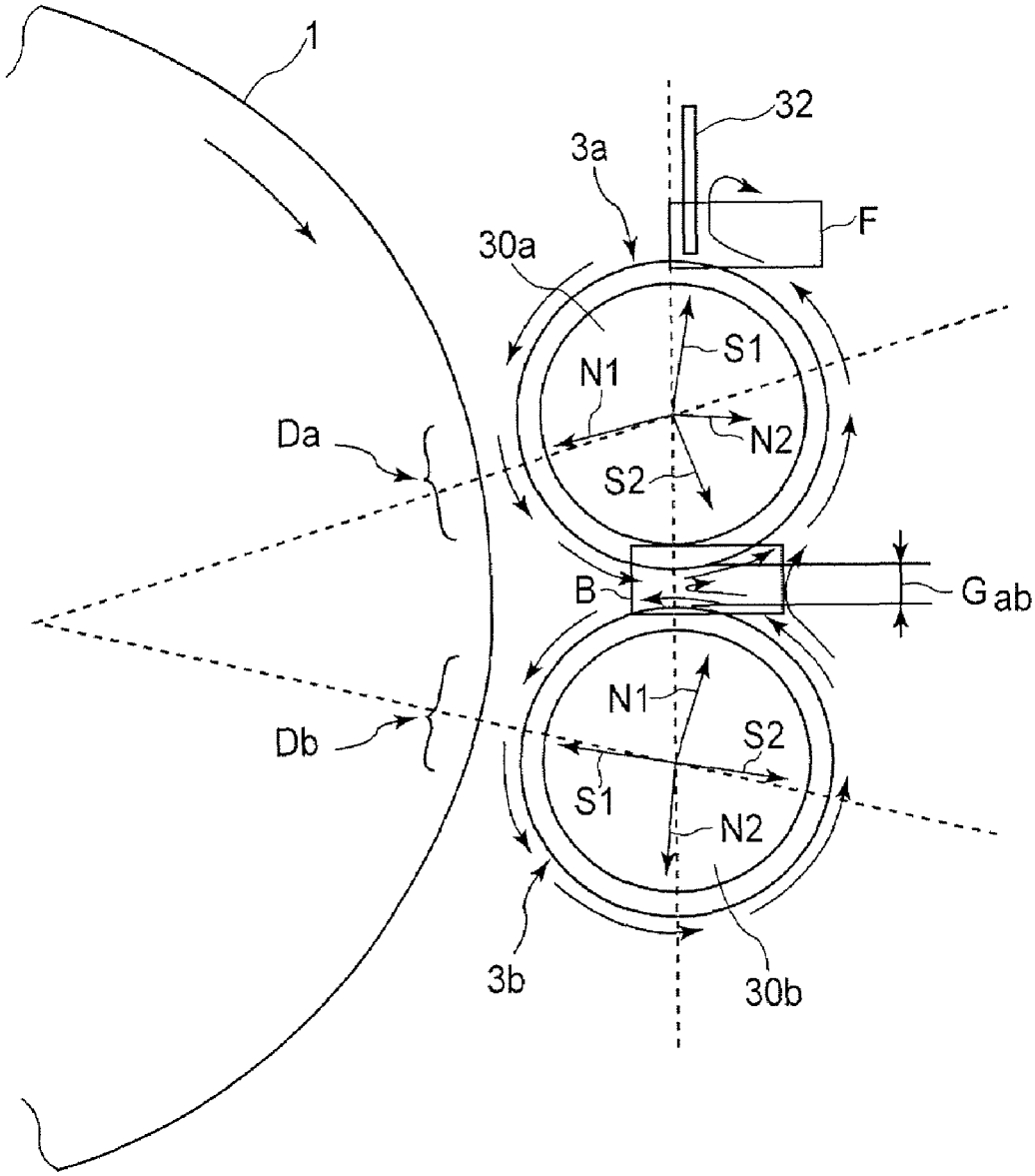
FIG. 7 is a schematic drawing of the essential portion of the developing apparatus based on the prior art, showing the positioning of the magnetic poles (magnet positioning pattern, area of developer stagnation, and direction of developer circulation.

FIG. 7 shows the pattern in which the magnetic poles of the magnetic rolls of a conventional image forming apparatus which employs two developer bearing members are positioned. The developer bearing members 3*a* and 3*b* contain the stationary magnetic rolls 30*a* and 30*b*, respectively. First, the experiments, which were carried out to study the effect of the magnetic force of the magnetic poles (S2 of developer bearing member 3*a* and N1 of developer bearing member 3*b*) positioned in the area in which the distance between the developer bearing members 3*a* and 3*b* is smallest, and the effect of the magnetic force of the magnetic poles (N1 of developer bearing member 3*a*, and S2 of developer bearing member 3*b*) positioned closest to the photosensitive drum 1, respectively, will be discussed. In these experiments, the developing apparatus was tested in "coating performance", "charging performance", "developer circulating performance", and "actual developmental performance". The results of the experiments are given in Table 1. in terms of the coating of the developer bearing member with developer

TABLE 1

| | Rollers | | | | | | | |
|---|---|---|---|---|---|---|---|---|
| | 30a | | 30b | | Results | | | |
| | N1 | S2 | S1 | N1 | CRT | CHA | CIR (B) | DEV |
| Exp. 1-1 | 90 | 70 | 90 | 50 | G | G | N | G |
| Exp. 1-2 | 90 | 70 | 90 | 30 | N | G | NN | G |
| Exp. 1-3 | 90 | 50 | 90 | 50 | G | G | G | G |
| Exp. 1-4 | 70 | 70 | 90 | 50 | G | G | N | G |
| Exp. 1-5 | 90 | 70 | 70 | 50 | G | G | F | N |

CRT: coating property
CHA: charging property
CIR (B): circulation property (zone B)
DEV: developing property
G: Good
F: Fair
N: No good
NN: Very Bad The stationary magnetic rolls 30*a* and 30*b* are positioned so that the pole N1 of the magnetic roll 30*a* and the pole S2 of the magnetic roll 30*b* are the magnetic poles positioned closest to the photosensitive drum 1, and also, so that the pole S2 of the magnetic roll 30*a* and the pole N1 of the magnetic roll 30*b* oppose each other in the area in which the distance between the developer bearing members 3*a* and 3*b* is smallest.

"Coating performance" refers to whether or not a toner layer which satisfies a set of requirements is formed on the developer bearing members 3*a* and 3*b*. More specifically, it refers to the toner distribution (amount per unit area) in terms of the lengthwise and circumferential directions of the developer bearing member 3, and also, the height of the crest which the toner particles on the developer bearing member 3 are made to form by the relationship between the magnetic force of the magnetic roll 30, relative permeability of toner, etc. The amount of toner on the developer bearing member 3 can be measured by collecting, by suction, the toner on an area of the peripheral surface of the developer bearing member 3, which is of a preset size. The position, height, and density of the portion of the magnetic brush, which are made to magnetically crest, by each of the magnetic poles of the developer bearing member 3, can be measured (observed) using an optical microscope.

The described above was the "coating performance" in microscopic terms. The "coating performance" is also importance in terms of macroscopic terms. That is, the developer bearing member 3*a* controls the "coating performance" by the location, material, angle, etc., of the regulating member 32, and magnetic force of the magnetic roll 30*a*. However, the "coating performance" regarding the developer bearing member 3*b* is determined by the strength of the magnetic field in the immediacies or adjacencies of the developer bearing member 3*b*, magnetic force of the developer bearing member 3*b*, the gap Gab (distance between developer bearing members 3*a* and 3*b*), etc.

If the amount of toner cannot be magnetically regulated in a satisfactory manner, a toner layer which is nonuniform in toner distribution in terms of the rotational direction of the developer bearing member 3, and also, nonuniform in density in the areas (areas Da and Db in FIG. 7) in which the distances between the developer bearing members 3 and the photosensitive drum 1 are smallest, will be formed on the developer bearing member 3. Further, the developer bearing members 3*a* and 3*b* rotate in the same direction. Therefore, if the toner on the developer bearing member 3*a* is entirely transferred onto the developer bearing member 3*b*, the toner layer on the peripheral surface of the developer bearing member 3*b* becomes excessively thick, failing thereby to remain uniform in thickness.

Next, "charging performance", which refers to the efficiency with which the toner particles become charged in the developing apparatus, will be described. Although the following were already stated above, in the case of a developing method which uses magnetic single-component toner, toner, as developing agent, is charged by utilizing the friction among toner particles and the friction between toner particles and developer bearing member. Thus the charging of the toner particles in the body of toner adhered to the developer bearing member 3*a* occurs in the adjacencies of the regulating member 32, and the charging of the body of toner adhered to the developer bearing member 3*b* occurs in the area in which the distance between the developer bearing member 3*b* and developer bearing member 3*a* is smallest (area B in FIG. 7). In the abovementioned experiments, "charging performance" was measured in terms of the amount of the charge which the toner itself had, by collecting the toner on the peripheral surfaces of the developer bearing members 3*a* and 3*b* with the use of a suctioning device.

In this embodiment, the target range of the charge was set to roughly −5--12 μc/mg. When the amount of the charge was no less than, or no more than, the abovementioned range, it was considered to be abnormal.

Next, "developer circulating performance" will be described. "Developer circulating performance" refers to the speed with which toner is circulated in the developing means container 31. The speed with which toner can be circulated can be increased, and also, can be stabilized, by reducing the amount of the pressure between toner and developer bearing members 3*a* and 3*b*, and the pressure among toner particles. If toner becomes stagnant at a specific area in the circulatory path of toner, toner becomes packed, which is liable to lead to toner deterioration.

Figure 8:
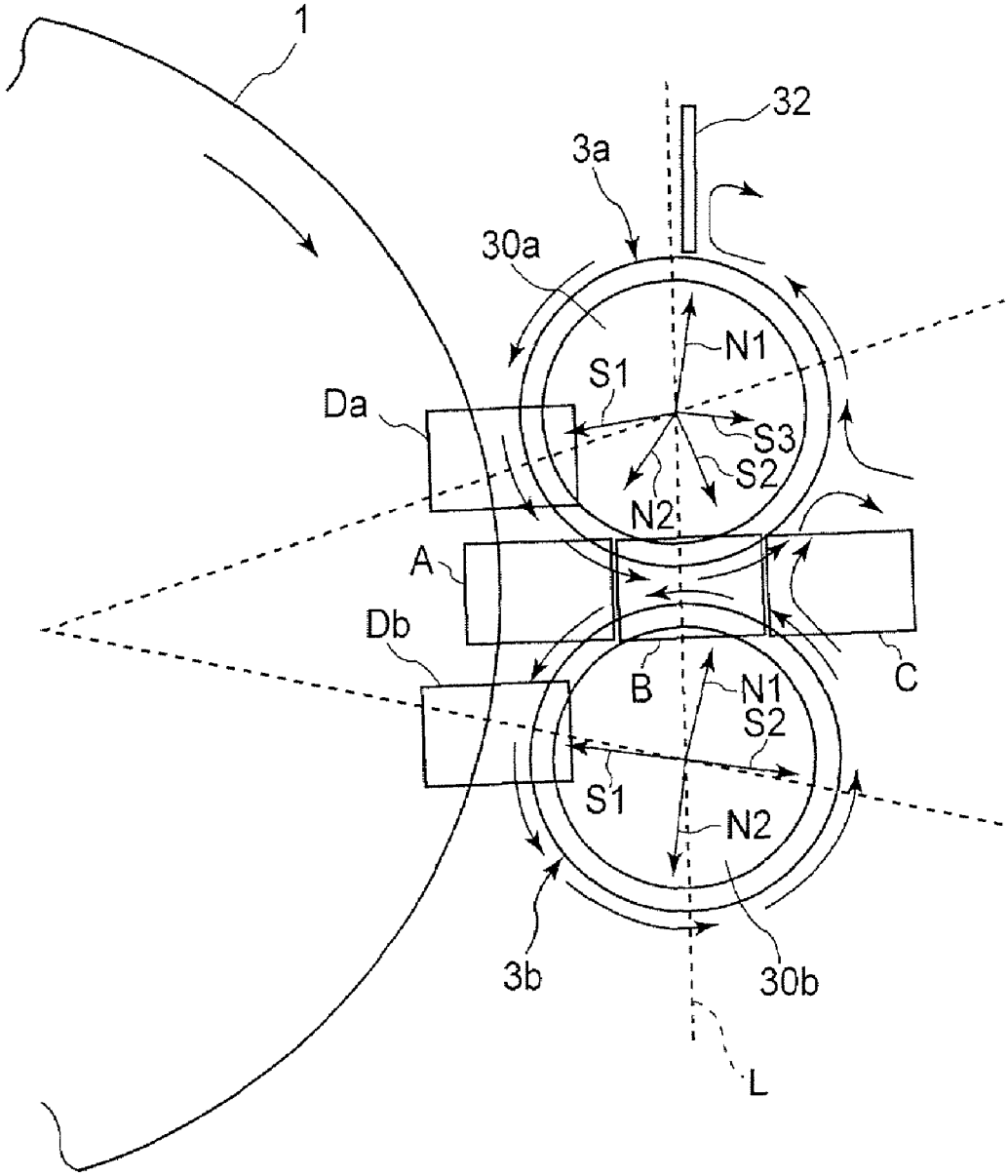
FIG. 8 is a schematic drawing of the essential portion of the developing apparatus based on the present invention, showing the area where the developer behavior was observed.

In the abovementioned experiments, in order to measure the "developer circulating performance", the moving toner particles were photographed at a rate of 256 frames per second, in three areas, that is, areas A, B, and C shown in FIG. 8, with the use of a microscope, which was fitted with a CCD, and a high speed video camera. The area A is the area surrounded by the developer bearing members 3*a* and 3*b* and photosensitive drum 1, and the area B is the adjacencies of the line of shortest distance between the developer bearing members 3*a* and 3*b*. The area C is the area which is between the developer bearing members 3*a* and 3*b*, and on the opposite side of the area B from the area A.

Shown in FIG. 8 is the ideal developer circulation pattern. That is, the toner circulation around the developer bearing member 3*a* and the toner circulation around the developer bearing member 3*b* are independent from each other. However, in the area C, a part of the body of toner which was moving with the peripheral surface of the developer bearing member 3*b* transfers onto the developer bearing member 3*b* without becoming stagnant. It is important that, in the area B, the theoretical contact area between the toner layer on the developer bearing member 3*a* and the toner layer on the developer bearing member 3*b* is as small as possible to prevent the developer transfer between the two developer bearing members 3*a* and 3*b*. That is, it is important that the magnetic force which holds the toner particles to the developer bearing members 3*a* and 3*b* is increased in strength. Further, it is most ideal that the tone particles on the developer bearing member 3*a* is conveyed to the areas B and C without being transferred onto the developer bearing member 3*b* in the area A. Should the toner particles (developer particles) transfer onto the developer bearing member 3*b* in the area A in a developing apparatus which uses magnetic single-component developer, the toner particles are directed toward the photosensitive drum 1 by electrostatic force, instead of being directed toward the magnetic roll 30*b*, unlike in the area (A) in a developing apparatus which uses the developing method based on two-component developer. Therefore, it is highly possible that an image which is defective in that its white areas suffer from fog, lines with missing sections, etc., will be formed.

Next, the method for testing (measuring) "actual developing performance" will be described.

Although the following was stated above, high voltage (relative to potential level of latent image on the photosensitive drum 1) is applied to the developer bearing members 3*a* and 3*b*, in the areas Da and Db, shown in FIG. 8, which are the areas in which the distances between the developer bearing member 3*a* and photosensitive drum 1 and between the developer bearing member 3*b* and photosensitive drum 1 are smallest, respectively. The resultant differences in potential level between the developer bearing members 3*a* and the area of the photosensitive drum 1 having the electrostatic image, and between the developer bearing member 3*b* and the area of the photosensitive drum 1 having the electrostatic image, cause the toner particles to jump from the developer bearing members 3*a* and 3*b* onto the photosensitive drum 1.

Thus, in order for the latent image to be precisely developed, it is important that there is a proper amount of toner on the area of the peripheral surface of the developer bearing member 3*a*, and also, on the area of the peripheral surface of the developer bearing member 3*b*, in the development areas Da and Db, respectively; toner particles have a proper amount of charge; and the development condition is proper.

In this embodiment, the developing method which uses magnetic single-component toner, which is negative in native polarity, is used. Toner particles are pulled toward the photosensitive drum by the electric field generated by the difference in potential level between the photosensitive drum and developer bearing members. On the other hand, toner particles contain magnetic substance. Therefore, they are pulled toward the developer bearing members by the magnetic force of the magnetic rolls. Further, as toner particles are charged (negatively), positive charge is generated on the back side of the surface of the developer bearing member, and this positive charge pulls the toner particles toward the developer bearing member.

In this embodiment, a combination of a DC component and an AC component is applied as bias to the developer bearing members as described above. On the other hand, it is evident that the magnetic poles of the magnetic rolls, in particular, those located in the development areas Da and Db, which affect the toner behavior, have significant effects upon image formation, as described above.

In this embodiment, the "actual developing performance" of the developing apparatus is judged by collectively using the measured potential level of a specific photosensitive drum, measured amount of toner on the solid white or black area, and measured amount of the toner having scattered on the recording medium, and also, observing the extent of the jumping of the toner particles on the peripheral surface of a photosensitive drum.

In the above described experiments, the directionality of the magnet pattern was confirmed by varying in strength the magnetic poles of the magnetic poles (which hereafter will be referred to as development poles) of the magnetic rolls 30*a* and 30*b*, which are in the development areas Da and Db, respectively, and also, varying in strength the magnetic poles (which hereafter will be referred to as cut poles) of the magnetic rolls 30*a* and 30*b*, which are in the area B.

The experiments were carried out under the above described condition, using the magnetic rolls 30*a* and 30*b* whose magnetic poles were positioned as described above, and the magnetic single-component developer described above. The magnetic rolls 30*a* and 30*b* were rotated at the above described peripheral velocity. In the experiments, the magnetic rolls different in magnetic pole position and magnetic pole strength were tested to confirm the effects of the differences in the positioning and strength of the magnetic poles upon the "coating performance", "charging performance", and "actual developing performance" of the developing apparatus.

Incidentally, toner affects the ambient humidity, which is an external disturbance factor, and the image ratio with which an image is outputted. Therefore, the experiments were carried out in severer ambiences. For example, the "coating performance", "developer circulating performance", and "charging performance" were tested in a high temperature-high humidity environment, which reduced toner in fluidity. The "developing performance", in particular, the jumping of toner particles onto the areas of the recording medium, which correspond to the solid white areas of an original (intended image), was tested in a low temperature-low humidity environment, with image ratio set low.

The magnet pole positioning pattern in Experiment 1-1 was very similar to that in a conventional developing apparatus. That is, the development pole N1 of the magnetic roll 30*a* was greater in strength than the cut pole S2 of the magnetic roll 30*a*, and the magnetic force of the cut pole S2 of the magnetic roll 30*a* was greater than that of the cut pole N1 of the magnetic roll 30*b*.

The results of this experiment showed the "coating performance", "charging performance", and "developing performance" were at unproblematic levels.

However, when the "developer circulation performance" was observed in this experiment, it was confirmed that the developer stagnated in the area B shown in FIG. 7. The cause for this phenomenon is that, because the magnetic force of the cut pole S2 of the developer bearing member 3*a* was greater than that of the bottom cut pole N1 of the developer bearing member 3*a*, the developer in the area B shifted toward the magnetic pole S2.

It became evident from this experiment that if the developing apparatus is continuously used for a long time with the developer circulating in the above described condition, it is highly possible that developer blocking, which is likely to cause toner deterioration, will occur in the area B. Therefore, if the apparatus is continuously used for a long period of time under this condition, it is highly possible that an image of a low grade will be formed.

Experiment 1-2 was different from Experiment 1-1 (in which conventional developing apparatus was tested) in that the strength of the cut pole N1 of the magnetic roll 30*b* in Experiment 1-2 was greater than that in Experiment 1-1.

The evaluation of the developing apparatus tested in Experiment 1-2 was "N" in "coating performance", and "NN" in "developer circulation performance".

As for the cause for the above described result of Experiment 1-2, the magnetic force of the cut pole N1 of the magnetic roll 30*b* was excessively small compared to that of the cut pole S2 of the magnetic roll 30*a*, and therefore, most of the toner was conveyed to the developer bearing member 3*a*, making it impossible for the peripheral surface of the developer bearing member 3*b* to be satisfactorily coated. Further, the toner (developer) particles from the development pole N1 of the developer bearing member 3*a* stagnated in the area B, and quickly agglomerated.

Experiment 1-3 was different from Experiment 1-1 only in that the developing apparatus tested in Experiment 1-3 was greater in the magnetic force of the cut pole S2 of the magnetic roll 30*a* than the developing apparatus tested in Experiment 1-1.

The test results showed that the "coating performance", "charging performance", "developer circulation performance", and "developing performance" of the developing apparatus were at unproblematic levels.

Experiment 1-4 was different from Experiment 1-1 in that the developing apparatus tested in Experiment 1-4 was smaller in the magnetic force of the development pole N1 of the magnetic roll 30*a* than that in the developing apparatus tested in Experiment 1-1. However, the magnetic pole S2 of the magnetic roll 30*a* was greater in strength than the cut pole N1 of the magnetic roll 30*b*. Therefore, the developing apparatus tested in Experiment 1-4 was inferior in "developer circulation performance", like the developing apparatus tested in Experiment 1-4.

In this experiment, even though the magnetic force of the development pole N1 of the magnetic roll 30*a* was 70 mT (which was substantially smaller than 90 mT in Experiment 1-1), the developing apparatus was not substantially lower in "developing performance", for the following reason: although images which suffered from fogs and/or scattered toner, that is, the images, the defects which are attributable to the magnetic roll 30*a*, were formed, the "developing performance" was good, because the toner particles which would have caused fogs were recovered by the magnetic roll 30*b*, and/or the scattered toner particles were rearranged by the magnetic roll 30*b*.

The developing apparatus tested in Experiment 1-5 was different from that in Experiment 1-1 in that it was smaller in the strength of the development pole S1 of the magnetic roll 30*b* than the developing apparatus tested in Experiment 1-1.

As will be evident from the results of the experiments described above, this developing apparatus was lower in "developing performance". Further, since the top cut pole S2 was greater in strength than the bottom cut pole N1, the developer stagnated in the area B, adversely affecting thereby the "developer circulation performance".

It is obvious, from the results of these experiments described above, that it is important, as one of the conditions for making a developing apparatus satisfactory in terms of "coating performance", "charging performance", "developer circulation performance", and "developing performance", that the strength of the cut pole S2 of the magnetic roll 30*a* is greater than that of the cut pole N1 of the magnetic roll 30*b*.

Further, the magnetic force of the development pole S1 of the magnetic roll 30*b* needs to be no less than a preset value, that is, 80 mT (which was not indicated in the description of experiments described above). Further, the strength of the magnetic force of the development pole S1 of the magnetic roll 30*b* must be optimized according to toner properties, development bias, potential of the peripheral surface of the photosensitive drum, etc.

Figure 9:
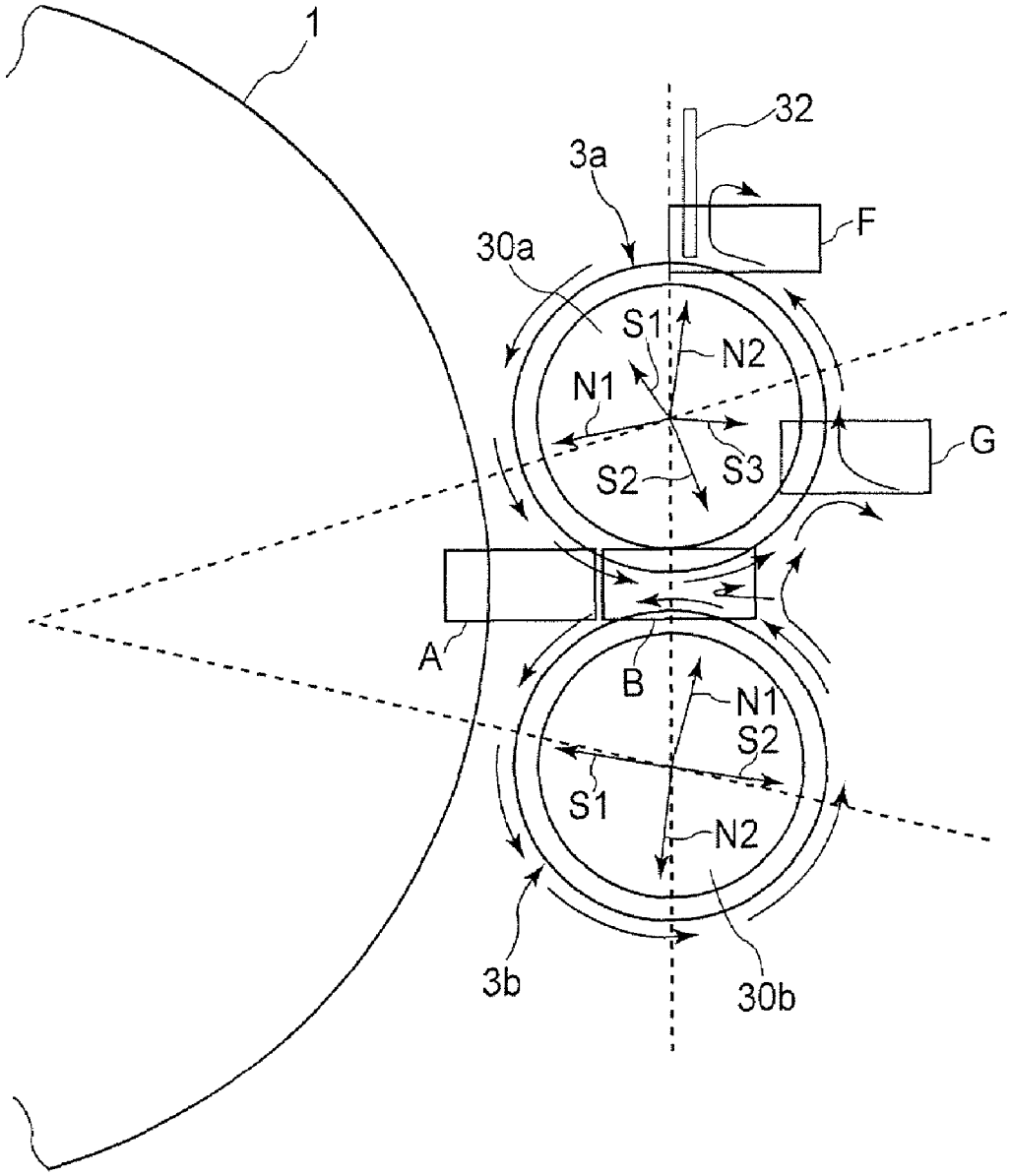
FIG. 9 is a schematic drawing of the essential portion of the developer apparatus, showing the pattern in which the magnetic poles of the magnetic roll provided with a repellent pole are arranged, and the direction of the developer circulation.

FIG. 9 shows a development system different from the conventional development system (FIG. 7) in that the developer bearing member 3*a* of this system is provided with an additional magnetic pole, that is, a magnetic pole S3, which is the same in polarity as the cut pole S1 of the developer bearing member 3*a*, and is disposed between the cut pole S2 of the developer bearing member 3*a* and the regulating member 32, in terms of the circumferential direction of the developer bearing member 3*a*.

In the conventional system shown in FIG. 7, after a coat of toner is conveyed by the cut pole S2 of the developer bearing member 3*a*, it is conveyed by the conveyance pole N2 of the developer bearing member 3*a* to the adjacencies of the regulating member 32. Then, the coat of toner is magnetically regulated, being thereby formed into a coat of toner which is uniform in the amount per unit area. Then, the toner particles in the coat of toner move (jump) from the area of the peripheral surface of the developer bearing member 3*a*, which correspond to the development pole N1 of the development pole N1, onto the photosensitive drum 1. In this system, the toner particles which moved past the regulating member 32 and area B, but, did not contribute to development, remain on the developer bearing member 3*a*. Therefore, virtually same body of developer (toner) is repeatedly conveyed through the area F.

Thus, this developing apparatus was longest in the time it takes for toner to move past the area which was high in the amount of the pressure to which toner was subjected. Therefore, it was confirmed through the experiments that the speed with which toner deteriorated increased when an image which was low in image ratio was formed.

As a means for minimizing the above described toner deterioration, there is a method for lowering the level of regulation at the regulating member regulates the body of toner on the developer bearing member, or temporarily pulling the toner particles away from the developer bearing member. It has been known that in the case of the former, as the regulation is reduced, the developing apparatus is reduced in toner charging performance, and further, is increased in the amount by which the development pole is supplied with toner, and as a result, toner particles are adhered to the areas of recording medium, which correspond to the solid while areas of an original (intended image). Therefore, as the means for minimizing the above described toner deterioration, it is necessary to temporarily pull the toner particles away from the developer bearing member, in particular, in the high speed mode, that is, the mode in which toner is deteriorated faster by the faster stirring speed, and the resultant increase in toner temperature, and therefore, a countermeasure has to be taken.

FIG. 9 shows the pattern in which the magnetic poles of the magnetic roll 30*a* are arranged for temporarily pulling toner away from the developer bearing member 30*a*. More specifically, the magnetic roll 30*a* is provided with a toner repelling pole S3, which is placed between the cut pole S2 and the regulating member 32, in terms of the circumferential direction of the magnetic roll 30*a*.

When the area G was observed through a high speed video camera to study the developer circulation in this system, it was found that the toner particles were moving in the directions indicated by arrow marks in FIG. 9.

Therefore, the pressure to which the developer was subjected in area F in this system was substantially smaller than that in the conventional system, confirming that this system is structurally superior to the conventional system in terms of the developer deterioration attributable to high speed operation.

Given below in Table 2 are the results of the experiments carried out to confirm the effects of the directionality of the magnetic poles of the developer bearing members 3*a* and 3*b* upon the performance of the developing apparatus.

TABLE 2

| | Rollers | | | | | | | | |
|---|---|---|---|---|---|---|---|---|---|
| | 30a | | 30b | | Results | | | | |
| | Dev. pole | Cut. pole | Dev. pole | Cut. pole | CRT | CHA | CIR (B) | DV | CIR (A) |
| Exp. 2-1 | S | N | N | S | G | G | G | G | F |
| Exp. 2-2 | S | N | S | N | F | F | N | G | G |
| Exp. 2-3 | S | S | S | N | G | G | G* | N | G |
| Exp. 2-4 | S | N | S | S | N | F | N | G | F |
| Mag. F. | 90 | 50 | 90 | 70 | | | | | |

Dev. pole: drum side developing pole
Cut. pole: cutting pole
CRT: coating property
CHA: charging property
CIR (B): circulation property (zone B)
CIR (A): circulation property (zone A)
DV: developing property
G: Good
F: Fair
N: No good
Mag. F.: magnetic force
*Two component develper In the experiments which will be described next, the effects of the relationship, in terms of polarity, among the development and cut poles of the magnetic roll 30*b*, upon the "coating performance", "charging performance", "developer circulation performance" in the area B, "developing performance", and also, the "developer circulation performance" in the portion of the area A, or the photosensitive drum side of the area A, were studied. The results were given in Table 2.

(1) Experiment 2-1: the top and bottom cut poles are different in polarity;

(2) Experiment 2-2: the top and bottom cut poles are the same in polarity;

(3) Experiment 2-3: the development and cut poles of the magnetic roll 30*b* are different in polarity;

(4) Experiment 2-4: the development and cut poles of the magnetic roll 30*b* are the same in polarity.

The developing apparatus tested in Experiment 2-1, which was the same in setup as that tested in Experiments 1, was good in the "developer circulation performance" through the area B, but, it was confirmed that as the apparatus was increased in speed (for example, to 800 mm/sec), a small amount of developer agglomerated in the area A. In other words, this developing apparatus needed to be improved.

Figure 10:
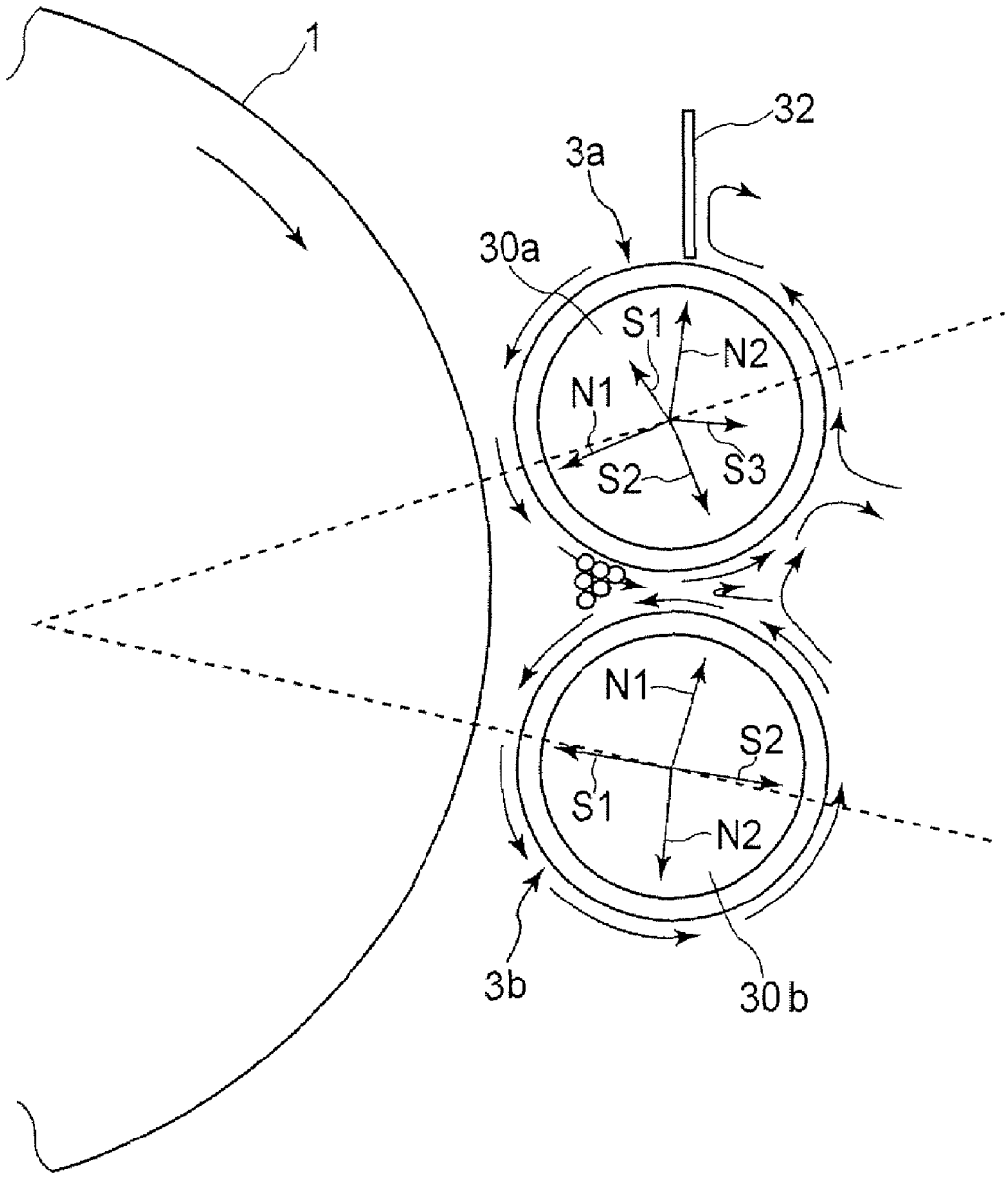
FIG. 10 is a schematic drawing of the essential portion of the developing apparatus, showing the pattern in which the magnetic poles are arranged, the location of the developer stagnation, and the direction of the developer circulation.

Described next will be the cause of the shortcoming of the developing apparatus tested in Experiment 2-2. It became evident from the experiment that the abovementioned collection of the developer was likely to occur when the rotational speed of the developer bearing member 3*b* was higher (800 mm/s, for example). FIG. 10 depicts an example of the developer collection.

To described the cause of the shortcoming of the developing apparatus tested in Experiment 2-1, of the area in which the distance between the developer bearing members 3*a* and 3*b* is smallest, the developer bearing member 3*a* side was weak (0-10 mT) in magnetic force. Therefore, the developer bearing member 3*a* was unable to carry toner (developer). Therefore, as the toner particles were carried to this area, they collected in this area, preventing thereby the developer bearing member 3*a* from being satisfactorily coated with the toner. This phenomenon became more conspicuous as the developer bearing member 3*a* was increased in rotational speed. Obviously, as the developer bearing member 3*a* was increased in rotational speed, the toner particles in the adjacencies of the peripheral surface of the developer bearing member 3*a* failed to remain adhered to the peripheral surface of the developer bearing member 3*a*; the toner conveyance failed to keep up with the increase in the rotational speed of the developer bearing members.

In the case of the developing apparatus tested in Experiment 2-2, the top and bottom cut poles are the same in polarity, and therefore, it was difficult for the developer to circulate through the area B. As a result, the developer bearing member 3*a* was unsatisfactorily coated with developer.

The cause for the abovementioned problem is as follows: Since the top and bottom cut poles were the same in polarity, the toner particles failed to be magnetically cut in a satisfactorily manner. As a result, the toner particles which were being carried by the developer bearing member 3*a* transferred onto the developer bearing member 3*b*. Incidentally, in the case of the developing apparatus, in which the development pole and cut pole of the magnetic roll 30*b* were the same in polarity, the "coating performance" was evaluated as x (Experiment 2-4).

In comparison, the developing apparatus tested in Experiment 2-3 was excellent in all aspects of its performance. However, toner particles jumped from the developer bearing member 3*a* onto the developer bearing member 3*b*, which resulted in the formation of an image whose solid white areas suffered from fogs. Therefore, this developing apparatus should not be used with single-component magnetic developer.

The following are evident from the above described results of Experiments 2-1-2-4: As long as the toner properties, development bias, distance between the developer bearing member and photosensitive drum, gap between the developer bearing members 3*a* and 3*b*, etc., which affect developing apparatus performance, are kept the same as those of the conventional developing apparatus, the cut pole of the magnetic roll 30*a* and the cut pole of the developer bearing member 30*b* are desired to be different in polarity, and also, the development and cut poles of the same magnetic roll 30 (30*a*, 30*b*) are desired to be different in pole.

As described above, the development system tested in Experiment 2-1 also needs to be improved.

Figure 11:
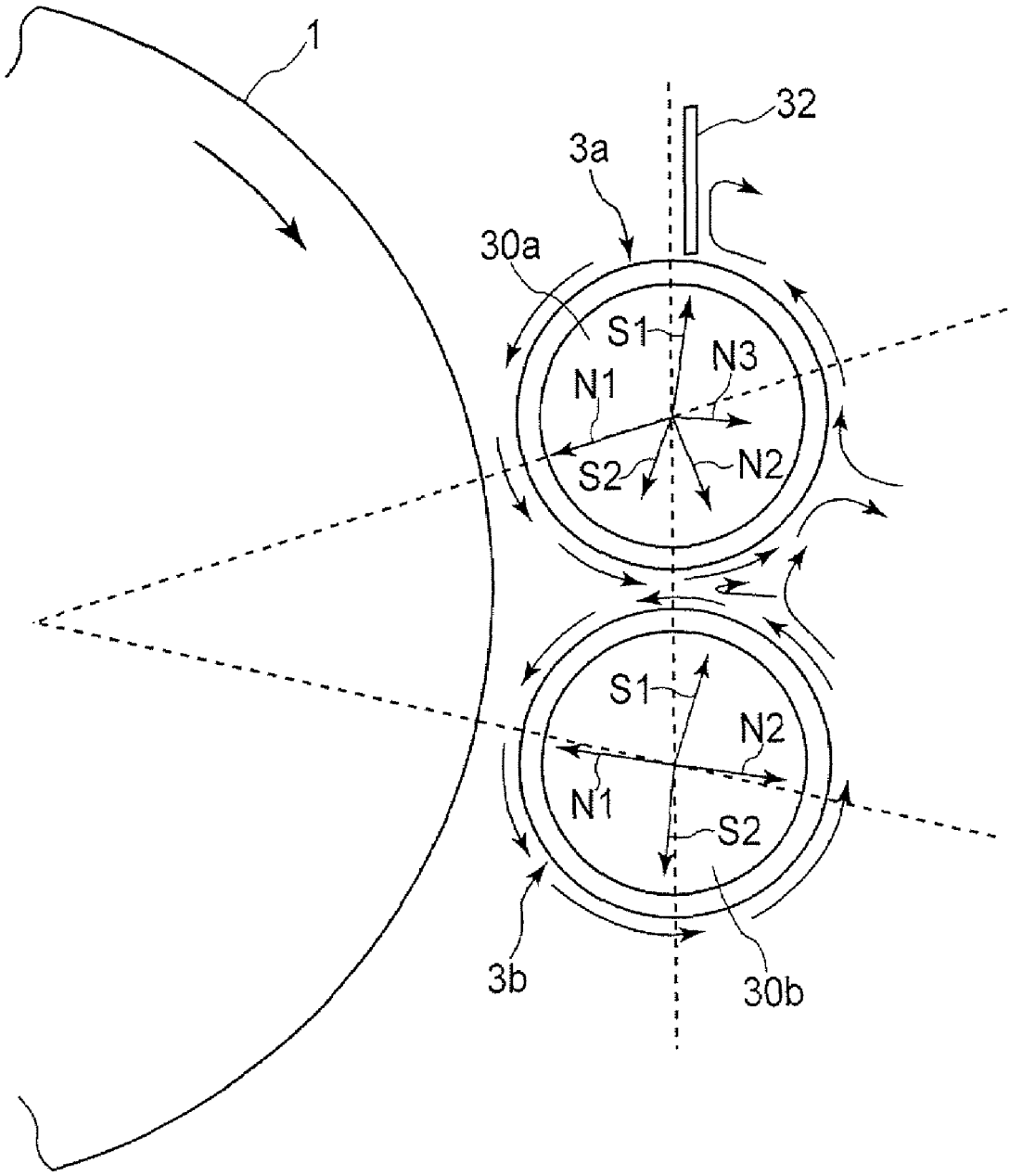
FIG. 11 is a schematic drawing of the essential portion of the developing apparatus, showing the pattern, in which the magnetic poles of the magnetic roll provided with a conveyance pole are arranged, and the direction of the developer circulation.

Shown in FIG. 11 is the essential portion of the developing apparatus, in which the magnetic roll 30*a* is provided with a conveyance pole, as a means for dealing with the increase in the operational speed of an image forming apparatus, which is strongly desired by users, and shows the pattern in which the magnetic poles are positioned. The results of the experiments carried out to study the effects of the conveyance pole upon the performance of the developing apparatus are given in Table 3.

TABLE 3

| | Rollers | | | | | | | | | |
|---|---|---|---|---|---|---|---|---|---|---|
| | 30a | | | 30b | | | | | | |
| | Dev. pole (D) | Feed pole | Cut. pole (M) | Dev. pole (D) | Cut. pole (M) | Results | | | | |
| | | | | | | CRT | CHA | CIR (B) | DV | CIR (A) |
| E. 3-1 | S | N | N | N | S | G | G | F | G | F |
| E. 3-2 | S | N | S | S | N | G | G | G | G | G |
| Mag. F. | 90 | 70 | 50 | 90 | 70 | | | | | |

Dev. pole: drum side developing pole
Cut. pole: cutting pole (mag. side)
CRT: coating property
CHA: charging property
CIR (B): circulation property (zone B)
CIR (A): circulation property (zone A)
DV: developing property
G: Good
F: Fair
N: No good
Mag. F.: magnetic force The abovementioned conveyance pole was positioned between the development pole N1 and cut pole N2 of the developer bearing member 3*a* to stabilize the developer behavior by magnetically confining the developer.

Next, the effects of the polarity of the conveyance pole will be described.

Figure 12:
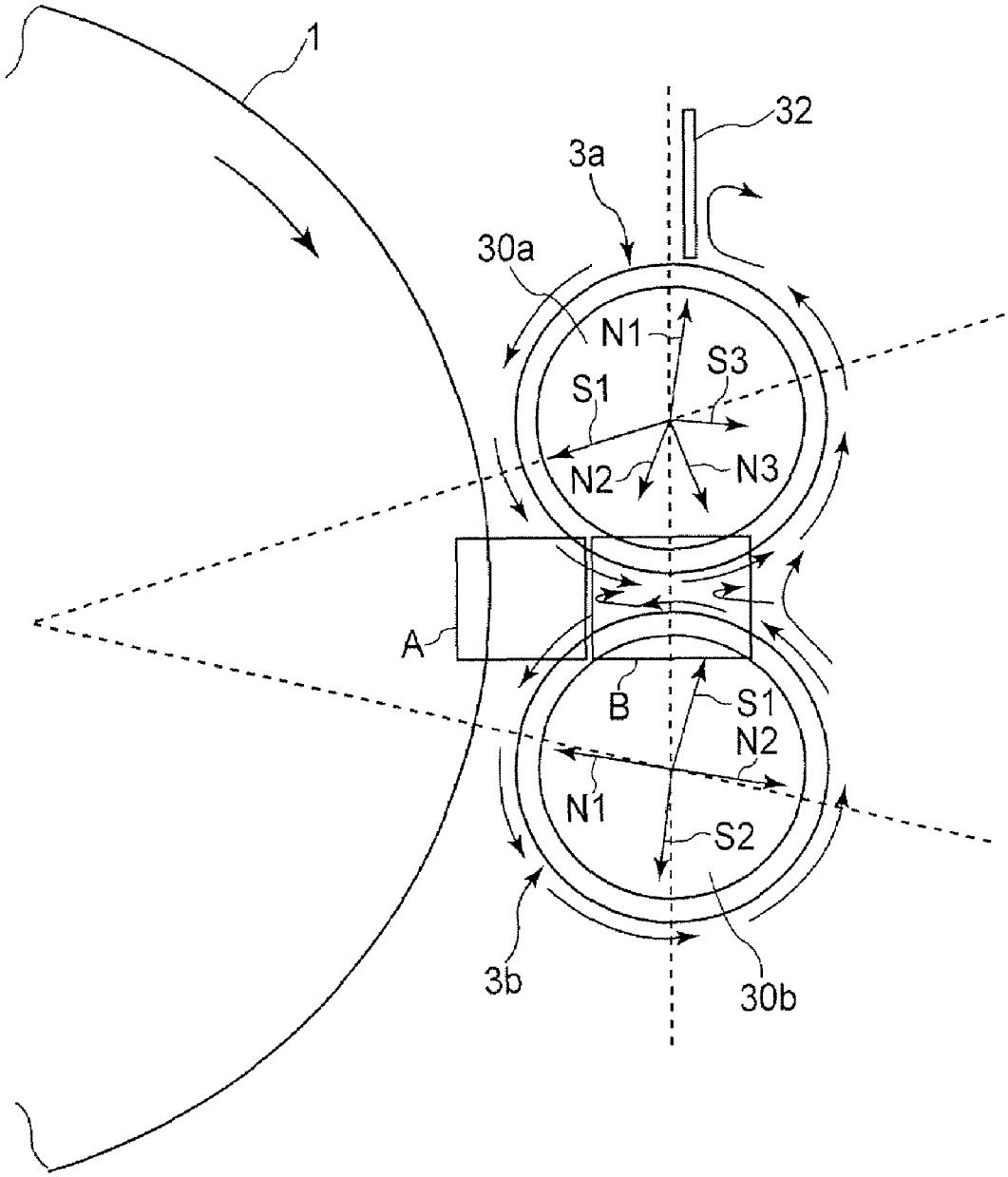
FIG. 12 is a schematic drawing of the essential portion of the developing apparatus, showing the direction in which the developer circulates in the developing apparatus in which the conveyance pole and cut pole are the same in polarity.

FIG. 12 shows the developing system in which the conveyance pole (magnetic pole N2) and cut pole (magnetic pole N3) are the same in polarity.

It was confirmed through the observation of the developer behavior that the developer collected in the area A, or the area surrounded by photosensitive drum 1, developer bearing member 3*a*, and developer bearing member 3*b*, and also, in the area B, or the area between the developer bearing members 3*a* and 3*b*, although it is by a very small amount.

The following became evident from this observation. That is, if the conveyance pole and cut pole are the same in polarity, the toner (developer) on the developer bearing member 3*a* is repelled s and transfers onto the developer bearing member 3*b*. Then, it is conveyed to the area corresponding to the development pole (N2) by the rotation of the developer bearing member 3*b*. However, it is attracted by the magnetic force of the conveyance pole of the developer bearing member 3*a*. Therefore, the developer collection occurs.

Thus, it is important that the conveyance pole and cut pole of the magnetic roll 30*a* are different in polarity.

Referring to FIG. 3, in this embodiment, the cut pole (magnetic pole A (S2) in FIG. 3) of the magnetic roll 30*a*, which is in the area B, and the cut pole (magnetic pole B (N1) in FIG. 3) of the magnetic roll 30*b*, which is in the area B, are different in polarity.

Next, referring to FIG. 8, the positioning of the magnetic poles in this embodiment will be described.

As described above, the developing apparatus 3 in this embodiment has the developer bearing first and second members (developer bearing members 3*a* and 3*b*), that is, the upstream and downstream members in terms of the rotational direction of the photosensitive drum 1, which are very closely positioned to each other. The developer bearing members 3*a* and 3*b* contain the magnetic rolls 3*a* and 3*b* as magnetic field generating means, respectively, each of which is provided with multiple magnetic poles.

The first magnetic roll, or the magnetic roll 30*a*, of the first developer bearing member, or the developer bearing member 3*a*, has first and second magnetic poles (development pole S1 and cut pole S2, respectively). The first magnetic pole (development pole S1) is the closest of all the magnetic poles of the magnetic roll 30*a* to the photosensitive drum 1, and the second magnetic pole (cut pole S2) is the closest of the all the magnetic poles of the magnetic roll 30*a* to the line of shortest distance between the first and second developer bearing members (3*a* and 3*b*, respectively). The first magnetic roll (30*a*) is also provided with a third magnetic pole (conveyance pole N2), which is located between the first magnetic pole (development pole S1) and second magnetic pole (cut pole S2).

The second magnetic roll, or the magnetic roll 30*b*, of the second developer bearing member, or the developer bearing member 3*b*, has a fourth magnetic pole (development pole S1), which is positioned close to where the distance between the second magnetic roll and photosensitive drum 1 is shortest. The second magnetic roll (30*b*) is also provided with a fifth magnetic pole (cut pole N1), which is positioned close to where the distance between the first and second developer bearing members (3*a* and 3*b*, respectively) are smallest. The magnetic force of the third magnetic pole is smaller than that of the fourth magnetic pole.

Further, the first magnetic roll (30*a*) is provided with a sixth magnetic pole (conveyance pole S3), which is on the downstream side of the second magnetic pole (cut pole S2), and on the upstream side of the first magnetic pole (development pole S1), in terms of the rotational direction of the developer bearing member (3*a*). Incidentally, the poles and poles N are different in polarity.

In addition to the above described tests, the developing apparatus in this embodiment was tested for the "coating performance", in particular, its ability to coat the developer bearing member 3*b* with developer in the abovementioned area B, while varying the angles (θ1 and θ2) of the cut poles of the magnetic rolls 30*a* and 30*b* relative to the line (L) which connects the rotational centers of the developer bearing members 3*a* and 3*b*.

Incidentally, the angels (θ1 and θ2) of the magnetic rolls 30*a* and 30*b*, respectively, are the same in absolute value. Further, the magnetic pole angle on the photosensitive drum side relative to the line connecting the rotational centers of the developer bearing members 3*a* and 3*b* was defined (will be referred to) as negative angle.

Table 4 shows the results of the above described experiments in which the developing apparatus in this embodiment was tested regarding the dependency of the developer bearing member coating performance upon the angles of the cut poles of the developer bearing members 3*a* and 3*b*.

TABLE 4

| | | Results | | | | |
|---|---|---|---|---|---|---|
| | Cut. pole position | CRT | CHA | CIR (B) | DV | CIR (A) |
| Exp. 4-1 | opposing position | F | F | G | F | G |
| Exp. 4-2 | drum side | G | N | G | N | F |
| Exp. 4-3 | container side | G | G | G | G | G |

Cut. pole: cutting pole
CRT: coating property
CHA: charging property
CIR (B): circulation property (zone B)
CIR (A): circulation property (zone A)
DV: developing property
G: Good
F: Fair
N: No good The developing apparatus was tested for the "coating performance", "charging performance", "developer circulation performance" in the areas A and B, and "developing performance", with the cut poles of the magnetic rolls 30*a* and 30*b* positioned 15° and −15° relative to the line connecting the rotational centers of the magnetic rolls 30*a* and 30*b*, and also, −15° and 15° relative to the line connecting and rotational centers of the magnetic rolls 30*a* and 30*b*.

As a result, the following became evident. That is, the thickness of the toner coat on the developer bearing member 3*b* is regulated by the developer bearing member 3*a*. Therefore, if the magnetic pole A of the developer bearing member 3*a* is positioned on the photosensitive drum side (outward) at an excessive angle, relative to line L, or the line connecting the rotational centers of the developer bearing members 3*a* and 3*b*, the toner coat on the developer bearing member 3*b* is disturbed, and therefore, toner charge could not be kept stable.

In the developing apparatus 3, in this embodiment, in which the magnetic poles of the magnetic rolls 30*a* and 30*b* are positioned as shown in FIG. 3, both the surface of the developer bearing member 3*a* and surface of the developer bearing member 3*b* can be reliably coated with a uniform thin layer of developer (magnetic single-component toner). Further the developing apparatus 3 is excellent in "charging performance", "developer circulation performance", etc. Therefore, it is possible to form an excellent image.

Incidentally, in this embodiment described above, the developing apparatus was designed to normally develop a latent image; it employed the photosensitive drum which is positive in native polarity, exposed the areas of the peripheral surface of the photosensitive drum, which corresponded to the background area of an original (intended image), and developed the latent image with the use of negative toner. However, even if a developing apparatus which is equipped with a photosensitive drum which is positive in native polarity, exposes the areas of the peripheral surface of the photosensitive drum, which correspond to the "image" portions of an original (intended image), and develops a latent image with the use of positive toner, the same results as those obtained by the developing apparatus in this embodiment can be obtained.

Embodiment 2

Next, the second preferred embodiment of the present invention will be concretely described with reference to the appended drawings.

Figure 13:
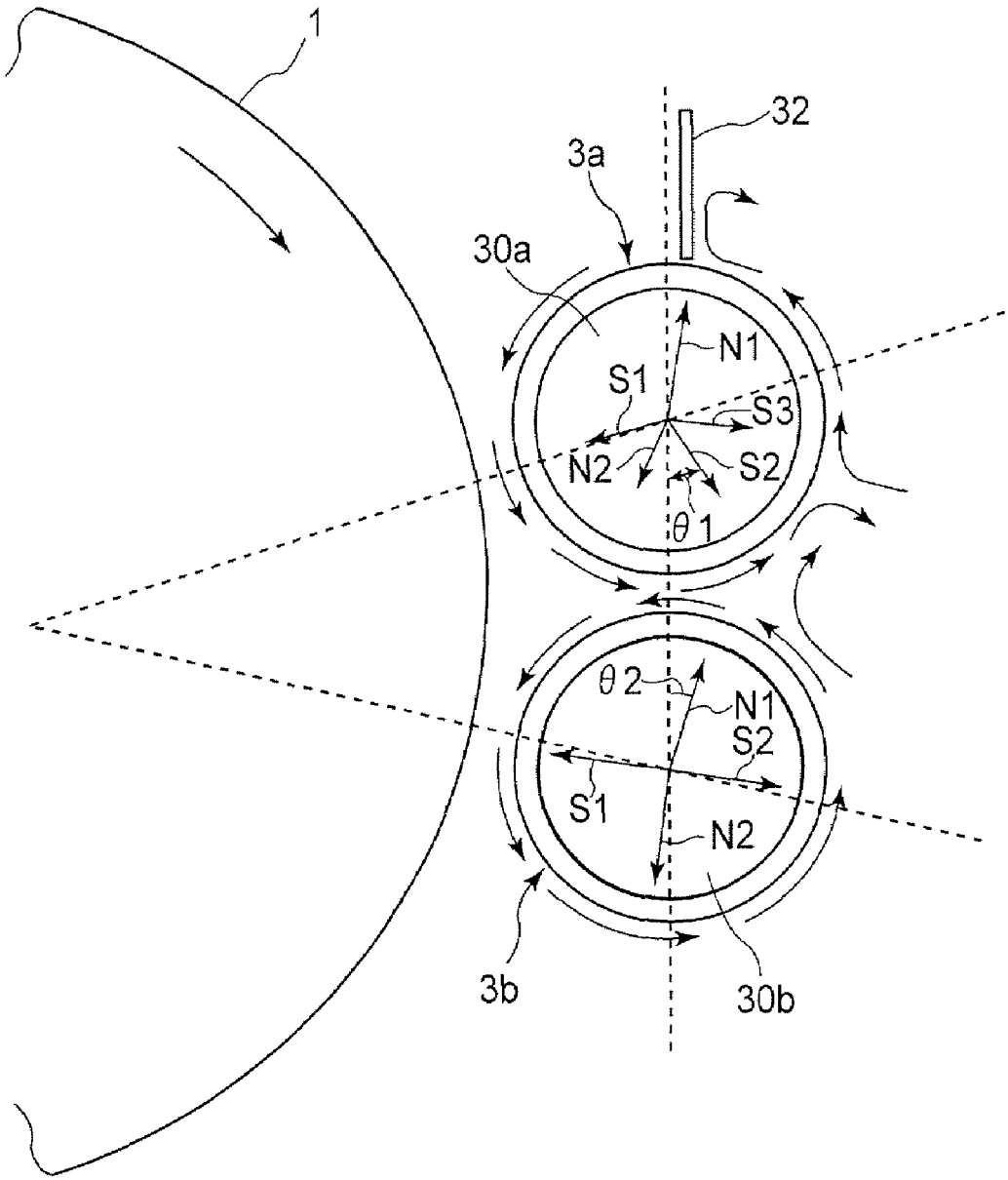
FIG. 13 is a schematic drawing of the essential portion of the developing apparatus in accordance with the present invention, showing the pattern in which the magnetic poles of the magnetic rolls are arranged, and the direction in which the developer circulates.
Figure 14:
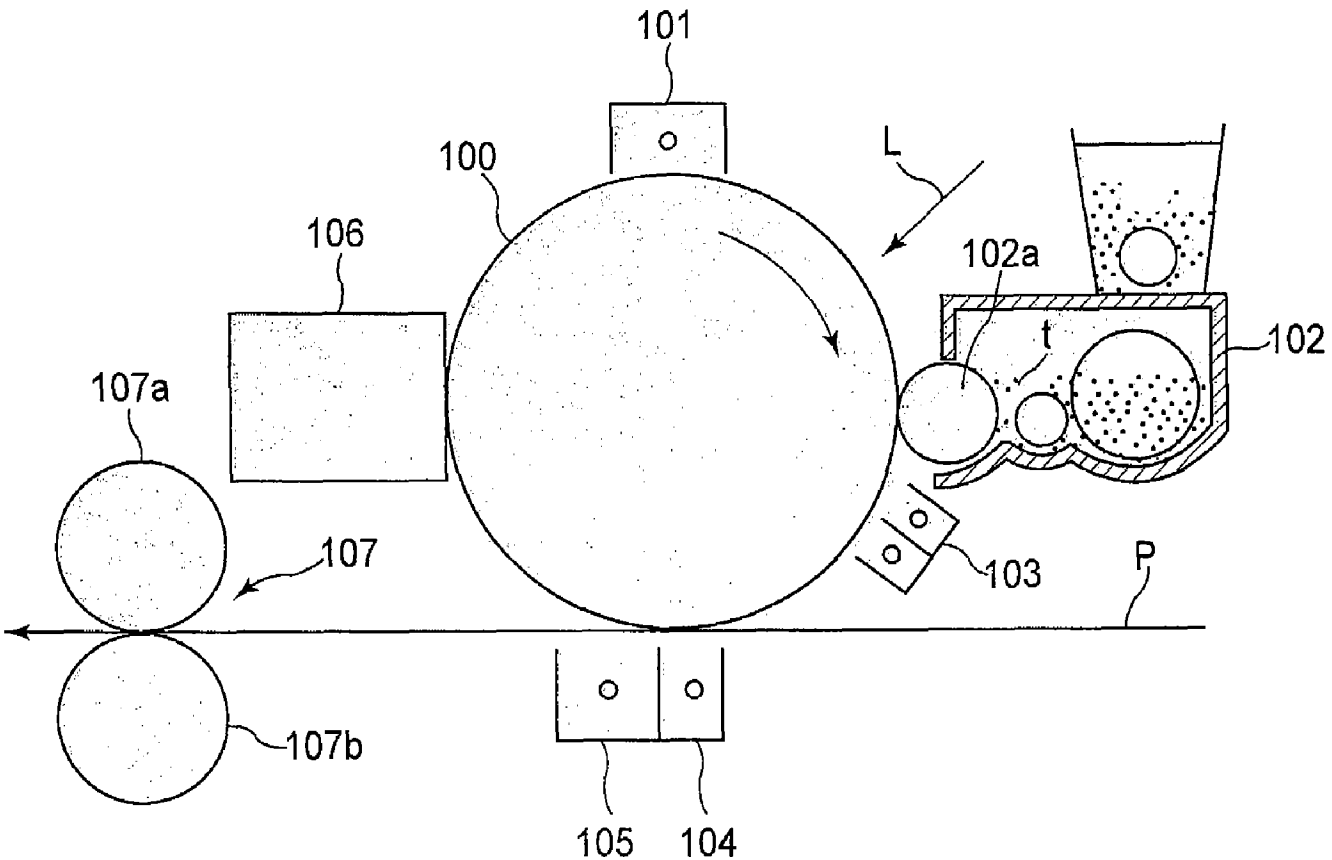
FIG.14 PRIOR ART
FIG. 14 is a schematic drawing of an example of an image forming apparatus equipped with a conventional developing apparatus which uses magnetic single-component developer.
Figure 15:
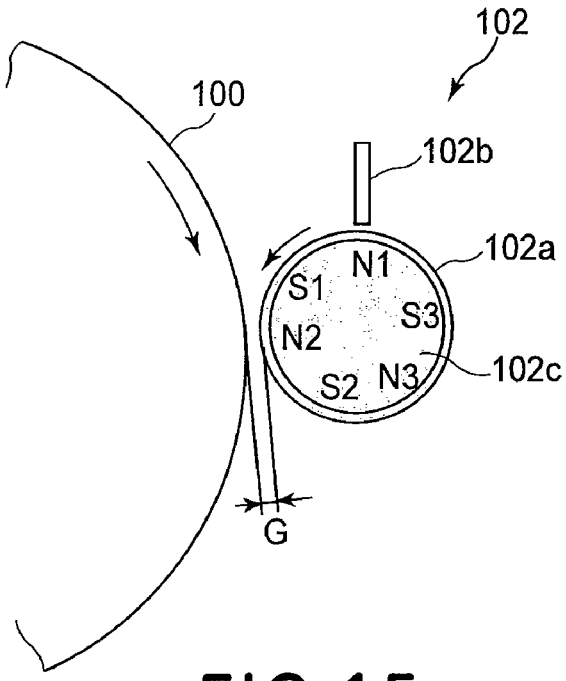
FIG.15 PRIOR ART
FIG. 15 is a schematic drawing of the essential portion of the conventional developing apparatus which uses magnetic single-component developer, showing the adjacencies of its regulating member.
Figure 16:
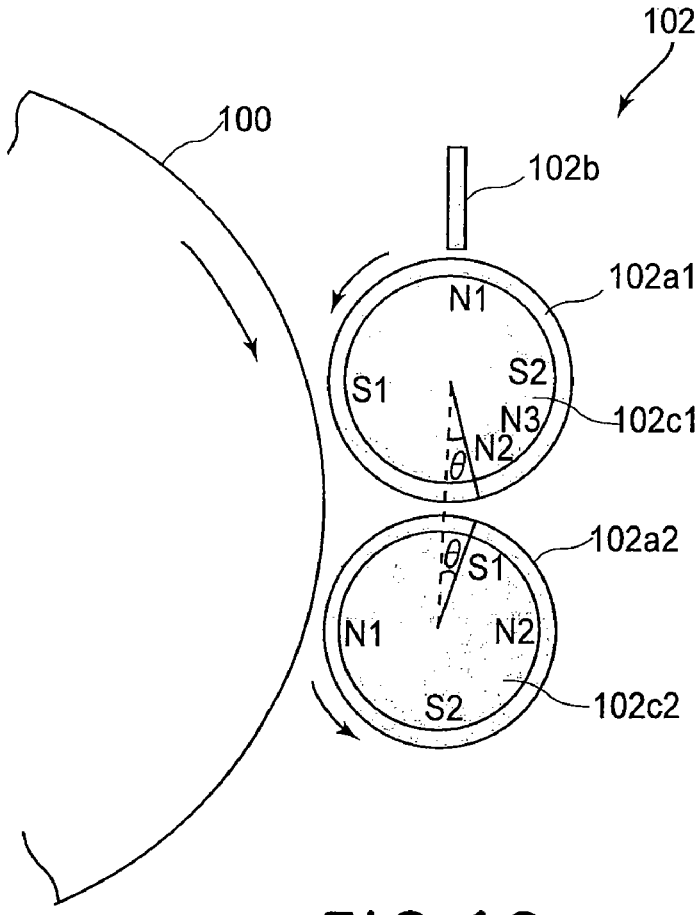
FIG.16 PRIOR ART
FIG. 16 is a schematic drawing of the essential portion of a conventional developing apparatus which employs multiple (two) developer bearing members, showing the pattern in which the magnet poles of the magnetic rolls are arranged.
Figure 17:
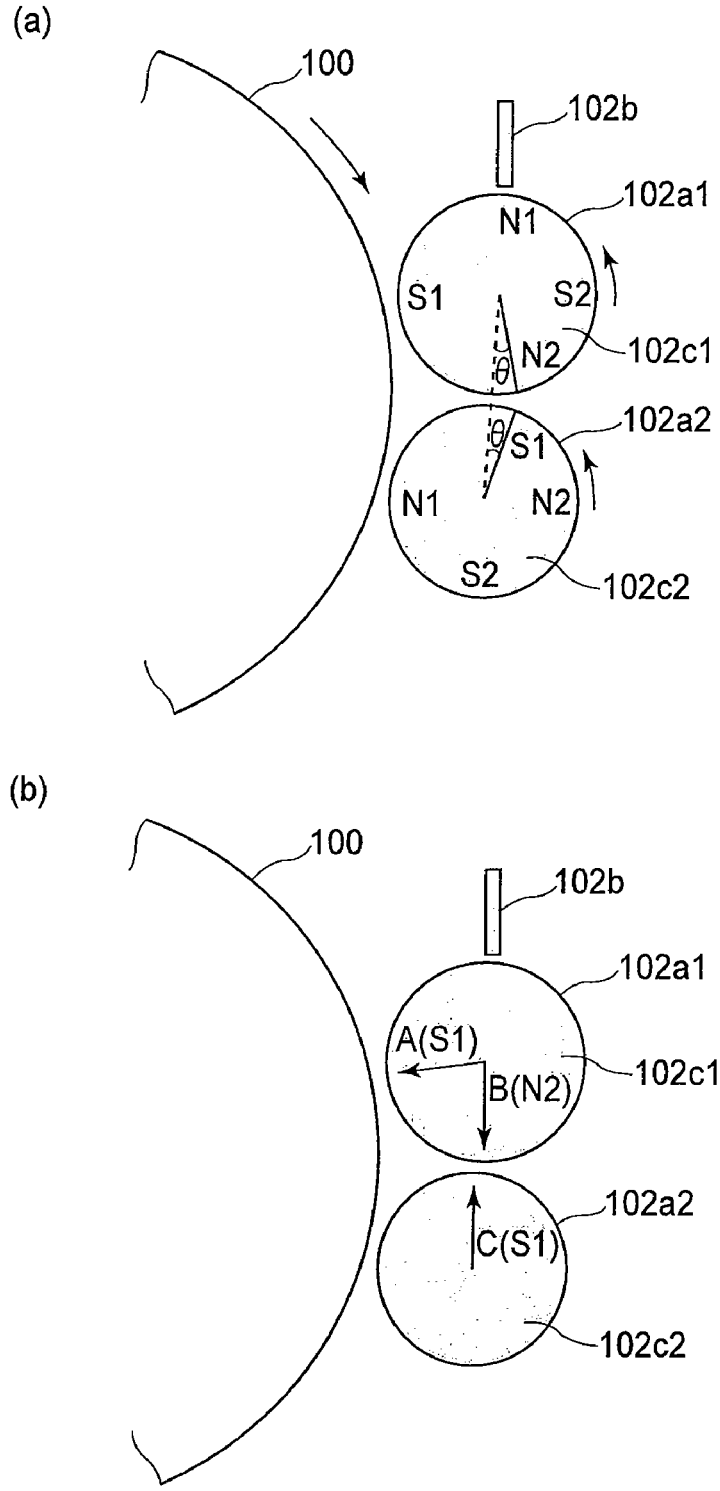
FIG.17 PRIOR ART
FIG. 17 is also a schematic drawing of the essential portion of a conventional developing apparatus which employs multiple (two) developer bearing members, showing the pattern in which the magnet poles of the magnetic rolls are arranged.
Figure 18:
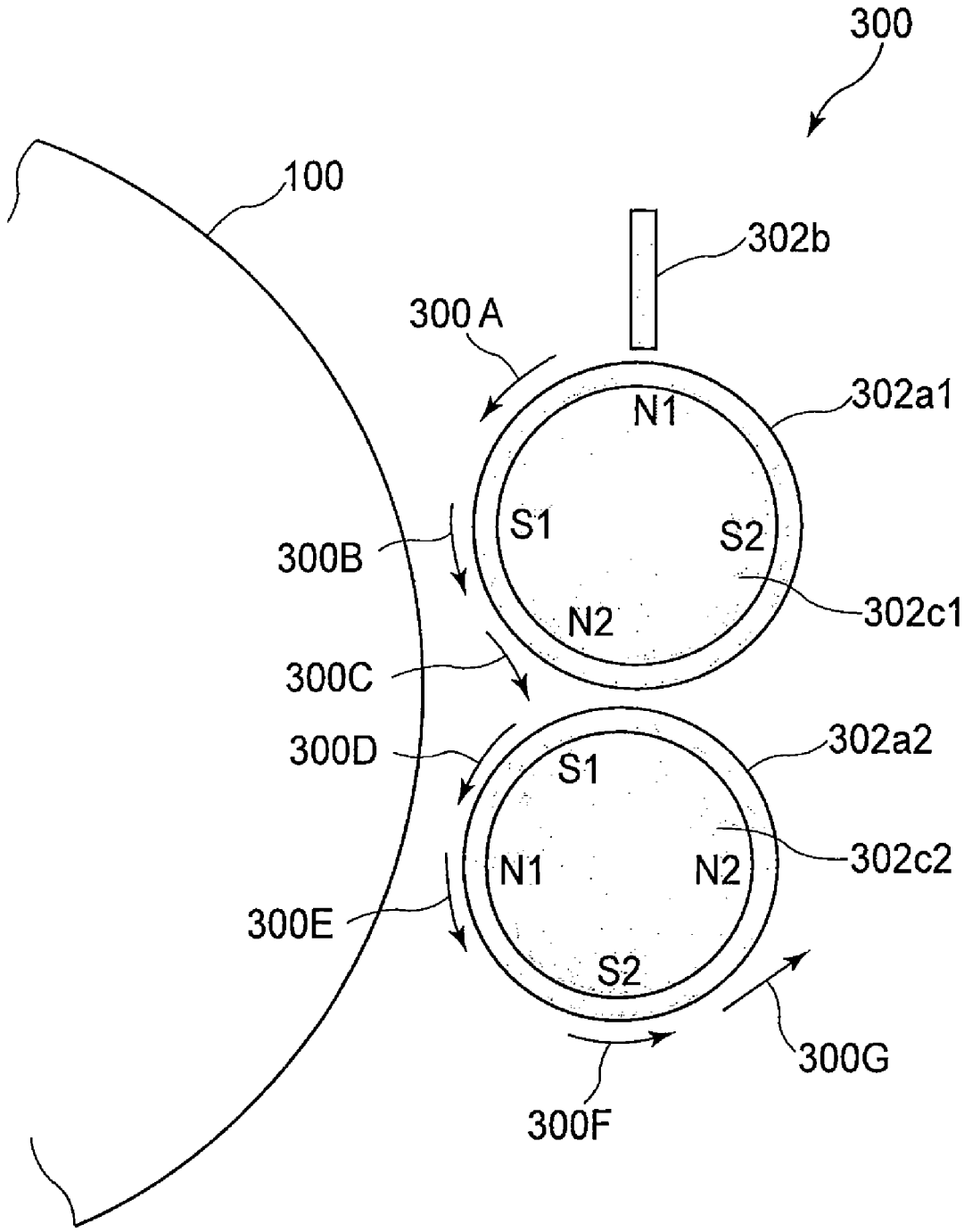
FIG.18 PRIOR ART
FIG. 18 is a schematic drawing of the essential portion of a conventional developing apparatus which employs multiple (two) developer bearing members, showing the pattern in which the magnet poles of the magnetic rolls are arranged, and the direction of developer circulation.

FIG. 13 shows the structure of the developer bearing members 3*a* and 3*b*, which contain magnetic rolls 30*a* and 30*b* which are in accordance with the present invention.

The magnetic rolls 30 and 30*b* in this embodiment are the same in structure as those in the first preferred embodiment, except for the strength of the magnetic force of each magnetic pole. In the drawing, the length of each arrow is proportional to the strength of the magnetic force of each magnetic pole. The results of the experiments which were different in the strength of the corresponding magnetic pole are given in Table 5, and the relationship between the angle of each magnetic pole and the performance of the apparatuses in terms of various functions of the developer bearing members are given in Table 6.

TABLE 5

| | Rollers | | | | | | | | | |
|---|---|---|---|---|---|---|---|---|---|---|
| | 30a | | | 30b | | Results (high speed, >=750 mm/s) | | | | |
| | Drm. side | Feed pole | Mag. side | Drm. side | Mag. side | | | | | |
| Pole | S1 | N2 | S2 | S1 | N1 | CRT | CHA | CIR (B) | DV | CIR (A) |
| E. 5-1 | 90 | 70 | 50 | 90 | 70 | G | G | F | G | F |
| E. 5-2 | 60 | 50 | 60 | 90 | 70 | G | G | G | G | G |

CRT: coating property
CHA: charging property
CIR (B): circulation property (zone B)
CIR (A): circulation property (zone A)
DV: developing property
G: Good
F: Fair

TABLE 6

| | Rollre 30a | | | | | | Roller 30b | | | |
|---|---|---|---|---|---|---|---|---|---|---|
| | D side S1 | | Feed N2 | | Mag. side S2 Cntr V. | | D side S1 | | Mag. side N1 | |
| | 60 | | 50 | | 60 Drctn | | 90 | | 70 | |
| | Dwn | Up | Dwn | Up | Dwn | Up | Dwn | Up | Dwn | Up |
| CRT | | | *1 | | | | | | *2 | |
| CHA | | | *3 | | | | | | *3 | |
| CIR(A) | | *4 | | | | | | *5 | | |
| CIR(B) | | | | *6 | *7 | *8 | | | *9 | *10 |
| DEV | *11 | | | | | | *11 | | | |
| Function separation | *12 | | *13 | | *14 | | *15 | | *16 | |

Upper: Magnetic roller 30a
Lower: Magnetic roller 30b
Upper sleeve: 3a
Lower sleeve: 3b
CRT: coating property
CHA: charging property
CIR (B): circulation property (zone B)
CIR (A): circulation property (zone A)
DV: developing property
*1: Developer movement to lower sleeve.
*2: Unstable toner amount.
*3: Low charge application power.
*4: Occurrence of zero point (lower developing pole).
*5: Occurrence of zero point (upper developing pole).
*6: Occurrence of zero point (lower cutting pole).
*7: Movement of developer to lower cutting pole.
*8: Movement of developer from lower cutting pole to upper cutting pole.
*9: Movement of developer to upper cutting pole.
*10: Movement of developer from upper cutting pole.
*11: Deterioration of image
*12: To eliminate the zero point relative to lower pole.
*13: Feeding pole not causing movement of developer to lower magnetic pole.
*14: Movement of developer toward repelling pole of upper sleeve.
*15: Developing property enhancement.
*16: Charge application power.

The test conditions were roughly the same as those for the developing apparatus in the first embodiment, except that the ambience in which the developing apparatus in this embodiment was tested was severer than that in which the developing apparatus in the first embodiment was tested. Further, the developing apparatus in this embodiment was subjected to durability tests and operational speed acceleration tests, in which recording mediums were continuously fed for image formation. In these experiments, the developing apparatus in this embodiment was tested for the effects of long term usage upon "coating performance", "charging performance", "developer circulation performance", and "developing performance". Attention was paid to the changes in the direction of toner movement which occurred during the duration tests. The results of these experiments revealed, for the first time, the developer collection which was quite different from the developer collection which occurred in a developing apparatus based on the prior art, and was never discovered by the earlier experiments.

In Experiment 5-1, in which the developing apparatus in this embodiment was tested under the first condition, the transfer of the developer from the cut pole S2 of the developer bearing member 3*a* (magnetic roll 30*a*) onto the cut pole N1 of the developer bearing member 3*b* (magnetic roll 30*b*) became conspicuous as the cumulative length of the operation increased. Further, the observation of the behavior of toner particles revealed that a low magnetism area was generated by the conveyance pole N2 of the developer bearing member 3*a* and the cut pole N1 of the developer bearing member 3*b*, in the borderline between the areas A and B, which is difficult to define because of the presence of the developer flow. Further, the decrease in the conveyance force of the developer bearing member 3*a* allowed the developer to stagnate in the adjacencies of the development pole, which overlapped with the development pole of the developer bearing member 3*b* and the low magnetism area. As a result, developer collected in this area.

In Experiment 5-2, a magnetic roll 30*a* which had been modified to solve the problems which occurred to the magnetic roll 30*a* tested in Experiment 5-1, was tested. That is, the magnetic roll 30*a* tested in this experiment was weaker in the magnetic force of the development pole S1 and conveyance pole N2, and stronger in the magnetic force of the cut pole S2. These modification solved the above described problems which the magnetic roll 30*a* tested in Experiment 5-1 had.

Table 6 shows the problems attributable to the function of each magnetic pole and the direction of the magnetic force of each magnetic pole. The factor of specific importance was the strength of each magnetic pole relative to the strength of the magnetic force of the cut pole N1 (third magnetic pole) of the magnetic roll 30*b*. Basically, a developing apparatus can be stabilized in the "coating performance", "charging performance", and "developer circulation performance", by designing the developing apparatus so that the top cut pole S2 (second magnetic pole), conveyance pole N2 (fourth magnetic pole), and development pole S1 (first magnetic pole) of the magnetic roll 30*b* are smaller in magnetic force than the cut pole N1 (third magnetic pole) of the magnetic roll 30*b*.

As for the "developing performance", it was confirmed that as long as the strength of the development pole S1 of the developer bearing member 3*b* was less than a preset value, which in this embodiment was 90 mT, a defective image was not formed, even if the development pole S1 of the developer bearing member 3*a* was slightly weak.

It became evident from the above described results that because the strength of each magnetic pole of the magnetic rolls of a developing apparatus in the second embodiment was set as described above, the developing apparatus in the second embodiment was superior to the developing apparatus in the first embodiment, in terms of the "coating performance", "charging performance", and "developer circulation performance" when there were external disturbances.

The development condition for the developing apparatus in this embodiment are the same as that for the developing apparatus in the first embodiment. However, this condition is an example; the development condition is desired to be optimized according to the specification of the employed image forming apparatus, and the ambience in which the apparatus is used.

Incidentally, the image forming apparatuses in the preceding preferred embodiments of the present invention were black-and-white image forming apparatuses which used magnetic single-component black toner as developer. However, the present invention is also applicable to a color image forming apparatus which uses magnetic single-component color toners, just as effectively as it is to the black-and-white image forming apparatus.

As described above, according to the present invention, developer can be circulated in the more ideal direction than the direction in which developer is circulated in a conventional developing apparatus. Therefore, the present invention can prevent developer from stagnating in a developing apparatus, and therefore, it can minimize the pressure to which developer is subjected as developer becomes stagnant in a developing apparatus. Therefore, it can prevent developer from becoming packed and/or agglomerated as ambient temperature increases and/or development rollers are increased in rotational speed. Therefore, the present invention is capable of extending the service life of developer. Further, the present invention is effective to improve a developing apparatus in performance in terms of the coating of development rollers with developer, charging of developer, and circulation of developer, and therefore, is capable of stabilizing developer consumption. Therefore, it is effective to improve an image forming apparatus in the level of quality at which the apparatus forms an image, compared to a developing apparatus based on the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 059664/2006 filed Mar. 6, 2006 which is hereby incorporated by reference.

What is claimed is:

1. An image forming apparatus comprising:

a rotatable image bearing member;

a first rotatable developer carrying member, disposed so as to be opposed to said image bearing member, for carrying a magnetic one component developer to a first developing position to develop a latent image on said image bearing member;

a second rotatable developer carrying member, disposed so as to be opposed to said image bearing member at a position downstream of said first developer carrying member with respect to a rotational direction of said image bearing member, for carrying the magnetic one component developer to a second developing position to develop a latent image on said image bearing member, wherein said second developer carrying member is rotatable in the same direction as a rotational direction of said first developer carrying member;

a first magnetic member provided in said first developer carrying member and having a plurality of magnetic poles; and a second magnetic member provided in said second developer carrying member and having a plurality of magnetic poles, wherein said magnetic poles of said first magnetic member includes:

a first magnetic pole which is closest to said image bearing member, a second magnetic pole having the same polarity as said first magnetic pole and disposed at a position which is adjacent to a closest position where said first developer carrying member and said second developer carrying member are closest to each other and which is downstream of the closest position with respect to the rotational direction of said first developer carrying member, and a third magnetic pole having a magnetic polarity different from that of said first magnetic pole and disposed upstream of said second magnetic pole and downstream of said first magnetic pole with respect to the rotational direction of said first developer carrying member, wherein said magnetic poles of said second magnetic member include:

a fourth magnetic pole which is closest to said image bearing member and which has the same polarity as said first magnetic pole; and a fifth magnetic pole which has a polarity different from that of said second magnetic pole which is disposed at a position opposed to said second magnetic pole adjacent to and upstream of said fourth magnetic pole with respect to the rotational direction of said second developer carrying member.

2. An apparatus according to claim 1, wherein a magnetic force provided by said fourth magnetic pole is greater than a magnetic force provided by said third magnetic pole.

3. An apparatus according to claim 1, wherein said first developer carrying member and said second developer carrying member are supplied with bias voltages in the form of a DC voltage biased with an AC voltage.

4. An apparatus according to claim 1, wherein said fifth magnetic pole has a magnetic force larger than that of said second magnetic pole.

5. An apparatus according to claim 1, wherein said fifth magnetic pole has a magnetic force larger than magnetic forces of said first magnetic pole, said second magnetic pole and said third magnetic pole.

6. An apparatus according to claim 1, wherein a layer thickness of the developer on said second developer carrying member is regulated by said first developer carrying member.

7. An apparatus according to claim 1, wherein said first developer carrying member and said second developer carrying member rotate in the rotational direction of said image bearing member.

8. An apparatus according to claim 1, further comprising a regulating member for regulating a layer thickness of the developer on said first developer carrying member.

* * * * *